US007066537B2

(12) United States Patent
Coffield et al.

(10) Patent No.: US 7,066,537 B2
(45) Date of Patent: Jun. 27, 2006

(54) CHAIR BACK CONSTRUCTION

(75) Inventors: Tim Coffield, Grand Rapids, MI (US); Marcus C. Koepke, Indianapolis, IN (US); Jay R. Machael, Muscatine, IA (US); Craig H. Schultz, Muscatine, IA (US); Erik A. Steffensen, Iowa City, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/991,626

(22) Filed: Nov. 18, 2004

(65) Prior Publication Data

US 2005/0121954 A1 Jun. 9, 2005

Related U.S. Application Data

(63) Continuation of application No. 09/882,140, filed on Jun. 15, 2001.

(51) Int. Cl.
*A47C 7/46* (2006.01)
*A47C 7/14* (2006.01)
*A47C 3/026* (2006.01)

(52) U.S. Cl. ..... 297/284.4; 297/284.2; 297/284.7

(58) Field of Classification Search ..... 297/284.2, 297/284.7, 284.4
See application file for complete search history.

(56) References Cited

U.S. PATENT DOCUMENTS 1,228,771 A * 6/1917 Hanger ..... 297/284.7
2,894,565 A * 7/1959 Conner ..... 297/284.7
3,008,764 A 11/1961 Pile
4,502,728 A * 3/1985 Sheldon et al. ..... 297/284.7
4,534,593 A * 8/1985 Ojala ..... 297/284.4
4,541,670 A * 9/1985 Morgenstern et al. ... 297/284.7
4,632,454 A * 12/1986 Naert ..... 297/284.4
4,634,178 A * 1/1987 Carney ..... 297/284.7
4,718,724 A * 1/1988 Quinton et al. ..... 297/284.7
4,722,569 A * 2/1988 Morgenstern et al. ... 297/284.7
5,460,427 A * 10/1995 Serber ..... 297/284.7 X
5,503,455 A 4/1996 Yang
5,507,563 A 4/1996 Arthur
5,567,010 A * 10/1996 Sparks ..... 297/284.4
5,567,011 A * 10/1996 Sessini ..... 297/284.7
5,601,336 A 2/1997 Troyas-Bermejo
5,632,526 A 5/1997 McLarty, III et al.
5,662,383 A 9/1997 Hand
5,725,277 A 3/1998 Knoblock
5,762,403 A 6/1998 Robinson
5,810,439 A 9/1998 Roslund, Jr.
5,842,264 A 12/1998 Roossien et al.
5,860,700 A * 1/1999 Lance ..... 297/284.2 X
5,911,478 A 6/1999 Goodman
5,975,632 A * 11/1999 Ginat ..... 297/284.7
5,975,634 A * 11/1999 Knoblock et al. ... 297/284.7 X
6,035,901 A 3/2000 Stumpf et al.

(Continued)

*Primary Examiner*—Rodney B. White
(74) *Attorney, Agent, or Firm*—Faegre & Benson, LLP

(57) ABSTRACT

A back for a chair includes fabric panel with a flexible carrier attached to the panel around its periphery. The carrier is configured to be secured along a bottom edge to a bottom portion of a chair back frame member. The carrier is also secured to two vertical frame supports at its two upper corners. Preferably, the upper carrier and frame connections are ball and socket joints. A lumbar support is provided that is easily height adjustable, by providing tension to the back frame and requires no screws or adjustment knobs in its adjustment mechanism.

23 Claims, 29 Drawing Sheets

U.S. PATENT DOCUMENTS 6,059,362 A * 5/2000 Lin ..... 297/284.7 X
6,059,368 A 5/2000 Stumpf et al.
6,079,785 A * 6/2000 Peterson et al. ..... 297/284.7
6,099,076 A 8/2000 Nagel et al.
6,102,482 A 8/2000 Dettoni et al.
6,113,186 A 9/2000 Holmes et al.
6,220,661 B1 4/2001 Peterson
6,254,190 B1 7/2001 Gregory
6,257,665 B1 7/2001 Nagamitsu et al.
6,279,998 B1 8/2001 Chu et al.
6,338,530 B1 * 1/2002 Gowing ..... 297/284.7 X
6,349,992 B1 * 2/2002 Knoblock et al. ... 297/284.7 X
6,354,662 B1 * 3/2002 Su ..... 297/284.7
6,367,877 B1 * 4/2002 Knoblock et al. ... 297/284.4 X
6,382,719 B1 5/2002 Heidmann et al.
6,394,545 B1 * 5/2002 Knoblock et al. ..... 297/284.4
6,419,318 B1 * 7/2002 Albright ..... 297/284.7
6,439,661 B1 8/2002 Brauning
6,460,928 B1 * 10/2002 Knoblock et al. ... 297/284.4 X
6,471,294 B1 * 10/2002 Dammermann et al. . 297/284.7
6,523,898 B1 * 2/2003 Ball et al. ..... 297/284.4 X
6,527,339 B1 * 3/2003 Voris ..... 297/284.7 X
6,572,190 B1 * 6/2003 Koepke et al. ..... 297/284.7 X
6,575,530 B1 * 6/2003 Fischer et al. ..... 297/284.7 X
6,626,494 B1 * 9/2003 Yoo ..... 297/284.7 X
6,695,403 B1 * 2/2004 Su ..... 297/284.7
6,698,833 B1 * 3/2004 Ball et al. ..... 297/284.7
6,805,405 B1 * 10/2004 Koo ..... 297/284.7
6,848,744 B1 * 2/2005 Raftery et al. ..... 297/284.7 X
2001/0043003 A1 * 11/2001 Knoblock et al. ..... 297/284.4
2002/0043841 A1 * 4/2002 Giacinto ..... 297/284.7
2002/0130541 A1 * 9/2002 Koo ..... 297/284.7
2004/0075319 A1 * 4/2004 VanSickle ..... 297/284.7 X
2005/0062323 A1 * 3/2005 Dicks ..... 297/284.4

* cited by examiner

CHAIR BACK CONSTRUCTION

CROSS REFERENCE TO PRIORITY APPLICATIONS

This application is a continuing application of application Ser. No. 09/882,140 and claims priority therefrom, the earlier application having been filed on Jun. 15, 2001 with the title of "Chair Back Construction" and is commonly assigned with the present application. Application Ser. No. 09/882,140 is incorporated herein in full by reference.

STATEMENT REGARDING FEDERALLY SPONSORED RESEARCH

Not applicable.

BACKGROUND OF THE INVENTION

1. Field of the Invention

The present invention relates generally to a chair of the type suitable for use in an office environment and, more particularly, to a reclining office chair having several structural and operating features which offer a number of ergonomic advantages over the prior art including a highly functional and aesthetically pleasing chair back.

2. Description of the Related Art

Over many years attempts have been made to design chairs for use in office environments which are comfortable to use and thereby avoid user fatigue over prolonged use. In one simple form a chair may be provided with a swivel base for ease of turning and include a control mechanism which permits the chair to rock. A disadvantage of these relatively simple chairs is that conjoint rocking motion of the chair seat and back naturally lifts the user's feet off the floor, which can create stability problems and place upward force on the front of the user's thighs which can reduce fluid circulation in the user's legs.

To improve on the foregoing chair construction, chair controls are known which provide for synchronous movement of the chair seat and back. Where office chairs are concerned, a "synchronous control" means the arrangement of a combined or dependent back adjustment and seat adjustment, that is to say the adjustment of the back inclination fundamentally also results in an adjustment of the sitting surface. An example of a synchronous chair control is disclosed in U.S. Pat. No. 5,318,345, issued to Olson and assigned to the common assignee herein. With the aforementioned Olson control, the chair back is designed to tilt at one predetermined rate of recline while the seat tilts synchronously at a much lesser rate. The result is that the user's feet are not lifted from the floor when the back is reclined. Also, fluid circulation in the user's legs is not interrupted by substantial upward movement of the forward end of the seat. Another advantage of this control is that undesirable "shirt pull" is minimized by the strategic location of the tilt axis. Other examples of synchronous chair controls are disclosed in U.S. Pat. Nos. 5,366,274 and 5,860,701 to name a few.

Another feature embodied in recently designed office chairs that offers considerable ergonomic advantages is a tilt limiter feature for the chair back. With such a mechanism built into the chair control, the user may selectively set the degree of back recline at a predetermined angle thereby adding to comfort as the chair is used. An example of such a tilt limiter mechanism is disclosed in U.S. Pat. No. 6,102,477 issued to Kurtz and assigned to the common assignee herein. This particular mechanism offers the advantage of providing for infinitely variable angles of tilt within a predetermined overall range. The mechanism is also highly cost-effective to construct.

Yet another feature of current ergonomically designed chairs is the provision of height and pivot adjustable arm pads. Such a feature is particularly advantageous in providing the user with additional support to the arms, forearms, wrists and shoulders in order to minimize repetitive stress injuries when the user is keyboarding, for example, while seated in the chair. An example of such an adjustable arm pad is disclosed in U.S. Pat. No. 5,908,221 issued to Neil. One advantage of the '221 structure is that it uses gas cylinders for arm pad height adjustment and thus is easily adjusted with the push of a single button.

Yet another feature of current ergonomically designed office chairs includes an adjustable lumbar support mechanism for providing preselected chair back tension in the region of the user's lower back. An adjustable lumbar support allows the chair user to select a comfortable level of pressure on the lower back depending upon the specific office task being performed. Such a mechanism is disclosed, for example, in U.S. Pat. No. 5,797,652.

Still another feature of certain ergonomically designed office chairs, particularly of recent vintage, is the incorporation of fabric mesh into the construction of the chair seat, and/or back. While mesh materials are well-known in the construction of lawn furniture seating, it has only been relatively recently that such materials have been used successfully in office seating. These materials offer the advantage of enhanced air circulation for and consequent heat transfer from the chair user's body, which can improve the comfort of the chair. An example of the use of such fabric mesh in an office chair is disclosed in U.S. Pat. No. 6,125,521 issued to Stumpf et al.

Yet another feature of certain ergonomically designed chairs is the provision of a seat cushion having the capability of effecting heat transfer from the chair user's buttocks area while at the same time offering comfort to the user while seated, together with adequate support. Known seat cushions having such capability may involve a passive or active air flow circulation feature of the type disclosed, for example, in U.S. Pat. No. 6,179,706.

BRIEF SUMMARY OF THE INVENTION

The below described chair is a totally redesigned ergonomic chair that incorporates improved functional aspects in all areas of a modular chair construction and in its use, including tilt limit control, seat adjustment, arm adjustment, lumbar support, cushion airflow, mesh attachment and modular base frame assembly.

The various subfeatures of these modular components are the subject of the following individual applications filed of even date herewith, all commonly assigned, the disclosures of which are incorporated in full by reference:

Multi-position Tilt Limiting Mechanism, Pat. No. 6,616,231;

Locking Device for Chair Seat Horizontal Adjustment Mechanism, Pat. No. 6,688,692;

Height and Pivot Adjustable Chair Arm, Pat. No. 6,702,386;

Lumbar Support for a Chair, Pat. No. 6,572,190;

Body Support Member, Pat. No. 6,598,251;

Ergonomic Chair, Pat. No. 6,609,755;

Chair of Modular Construction, Pat. No. 6,568,760.

A complete understanding of the present invention and other objects, advantages and features thereof will be gained from a consideration of the present specification which provides a written description of the invention, and of the manner and process of making and using the invention, set forth in such full, clear, concise, and exact terms as to enable any person skilled in the art to which it pertains, or with which it is most nearly connected, to make and use the same in compliance with Title 35 U.S.C. §112 (first paragraph). Furthermore the following description of preferred embodiments of the invention read in conjunction with the accompanying drawing provided herein represents examples of the invention in compliance with Title 35 U.S.C. §112 (first paragraph), but the invention itself is defined in the claims section attached hereto.

In each of these cases, features combine to provide an overall chair that is a significant improvement over the prior art.

Thus, for example, the new ergonomic chair provides a reclining chair having a four bar linkage system that causes the rear of the seat to elevate as the back is reclined lending an unusual and comfortable balance during reclining. A tilt limit control conveniently and effectively limits the degree of chair back tilt to one of three reclined positions by manual movement of a simple lever. Horizontal positioning of the chair seat cushion is accomplished using a simple locking device that allows the chair user to simply lift up on the front of the cushion and select a preferred horizontal cushion position. Height and pivot adjustable chair arms are actuated with the push of a button by gas cylinders lending convenient adjustment to suit a specific work task. A lumbar support is easily height adjustable, by providing tension to the back frame and requires no screws or adjustment knobs in its adjustment mechanism. A modular cushion includes a comfortable heat absorbing gel layer and is vented uniquely for air circulation. The back of the chair is of fabric mesh construction and includes a novel attachment system for superior comfort. The base of the chair is of modular construction that provides for ease of assembly and lends rigidity to the chair construction.

The present invention improves over the prior art by providing a back for a chair including a fabric panel with a flexible carrier attached to the panel around its periphery. The carrier is configured to be secured along a bottom edge to a bottom portion of a chair back frame member. The carrier is also secured to two vertical frame supports at its two upper corners. Preferably, the upper carrier and frame connections are ball and socket joints.

BRIEF DESCRIPTION OF THE SEVERAL VIEWS OF THE DRAWING

The foregoing and other novel features and advantages of the invention will be better understood upon a reading of the following detailed description taken in conjunction with the accompanying drawings wherein.

DETAILED DESCRIPTION OF A PREFERRED EMBODIMENT OF THE INVENTION

Figure 1:
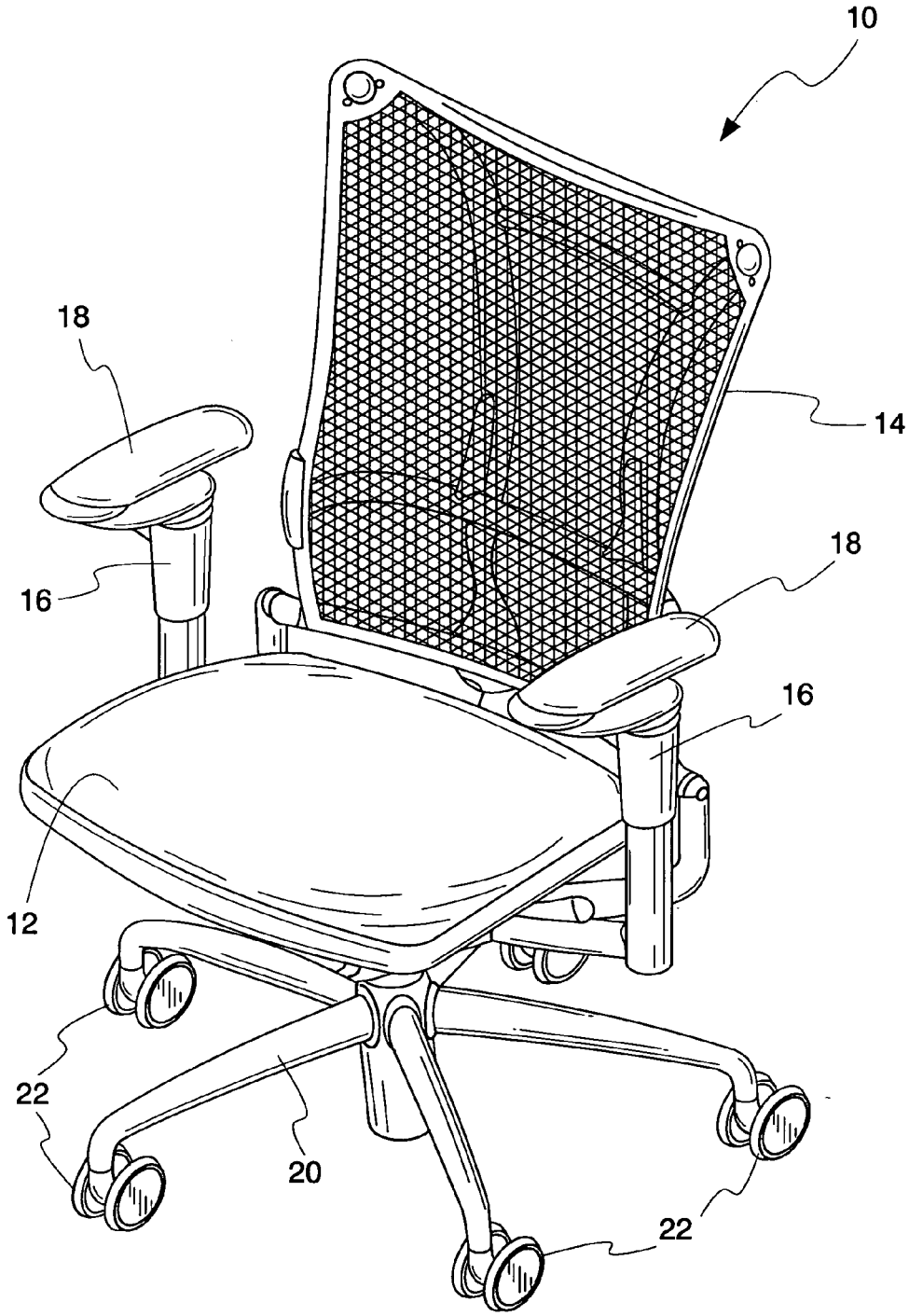
FIG. 1 is a left front perspective view of the above identified ergonomic chair incorporating all of the improved modular components.

While the present is open to various modifications and alternative constructions, the preferred embodiments illustrating the best mode contemplated by the inventors of carrying out their invention are shown in the various figures of the drawing and will be described herein in detail pursuant to Title 35 U.S.C. §112 (first paragraph). It is understood, however, that there is no intention to limit the invention to the particular embodiments, forms or examples which are disclosed herein. To the contrary the intention is to cover all modifications, equivalent structures and methods and alternative constructions falling within the spirit and scope of the invention as express in the appended Claims section attached hereto pursuant to Title 35 U.S.C. §112 (second paragraph).

Figure 2:
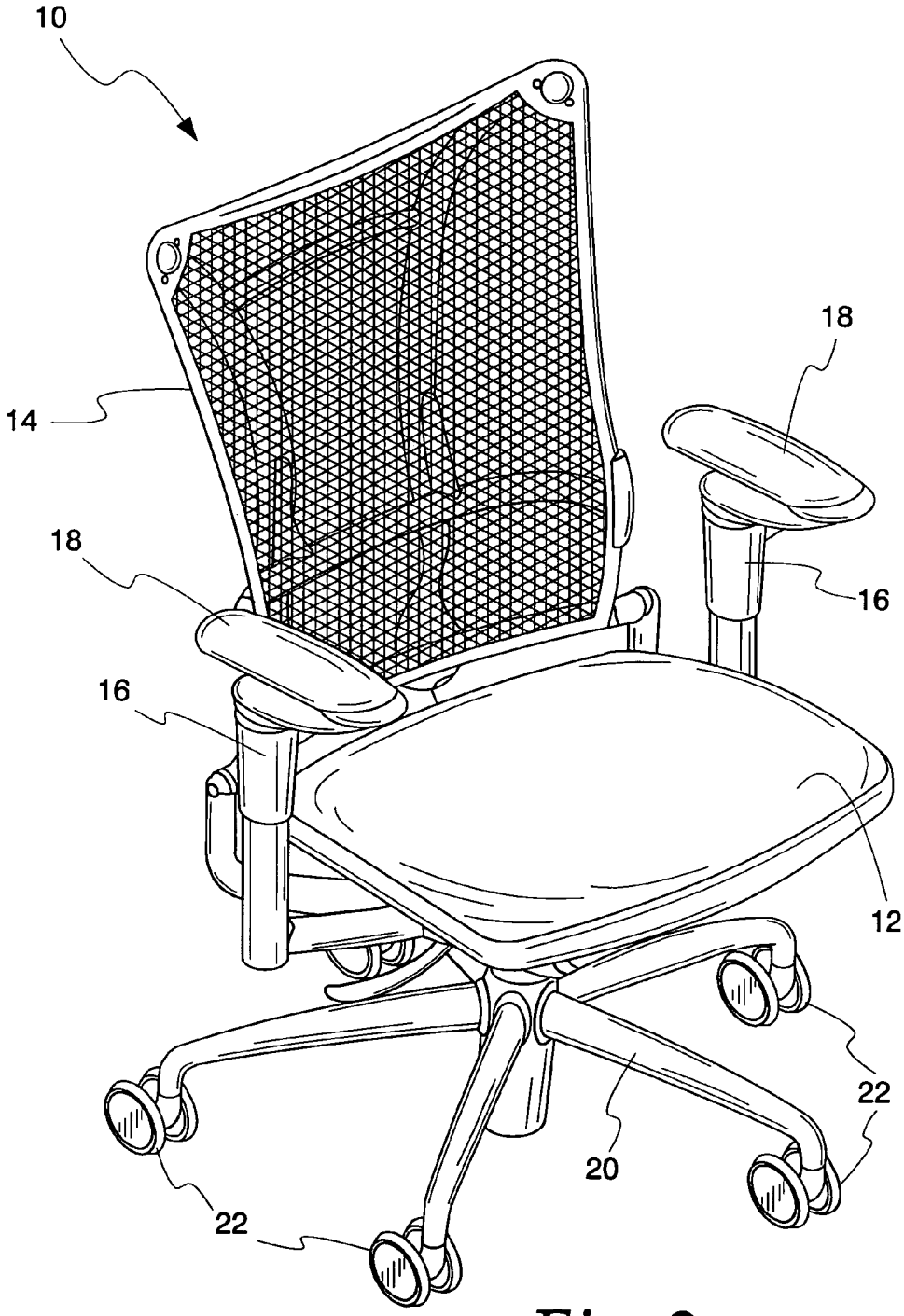
FIG. 2 is a right front perspective view thereof.
Figure 2A:
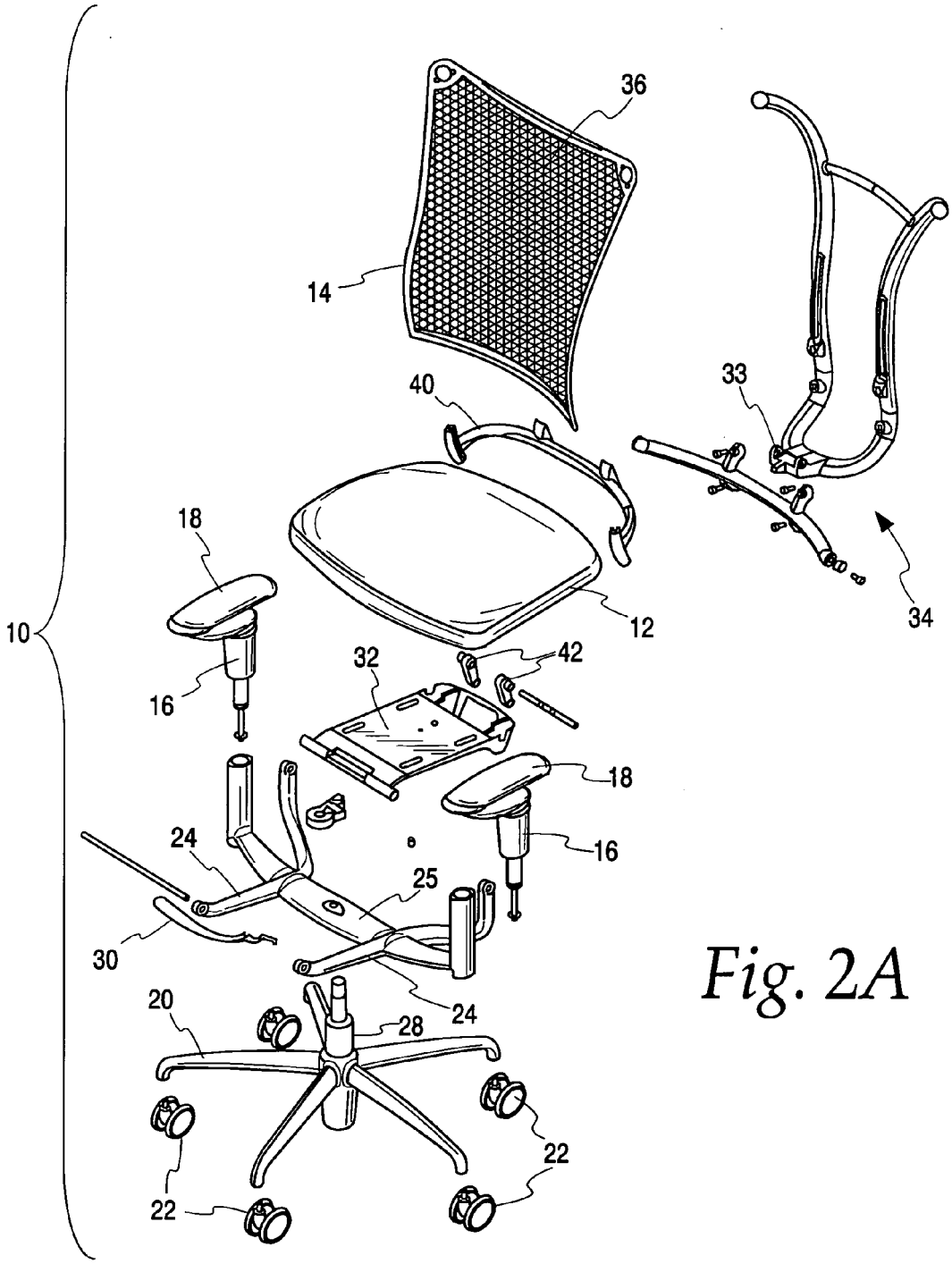
FIG. 2*a* is an exploded perspective view thereof.
Figure 3:
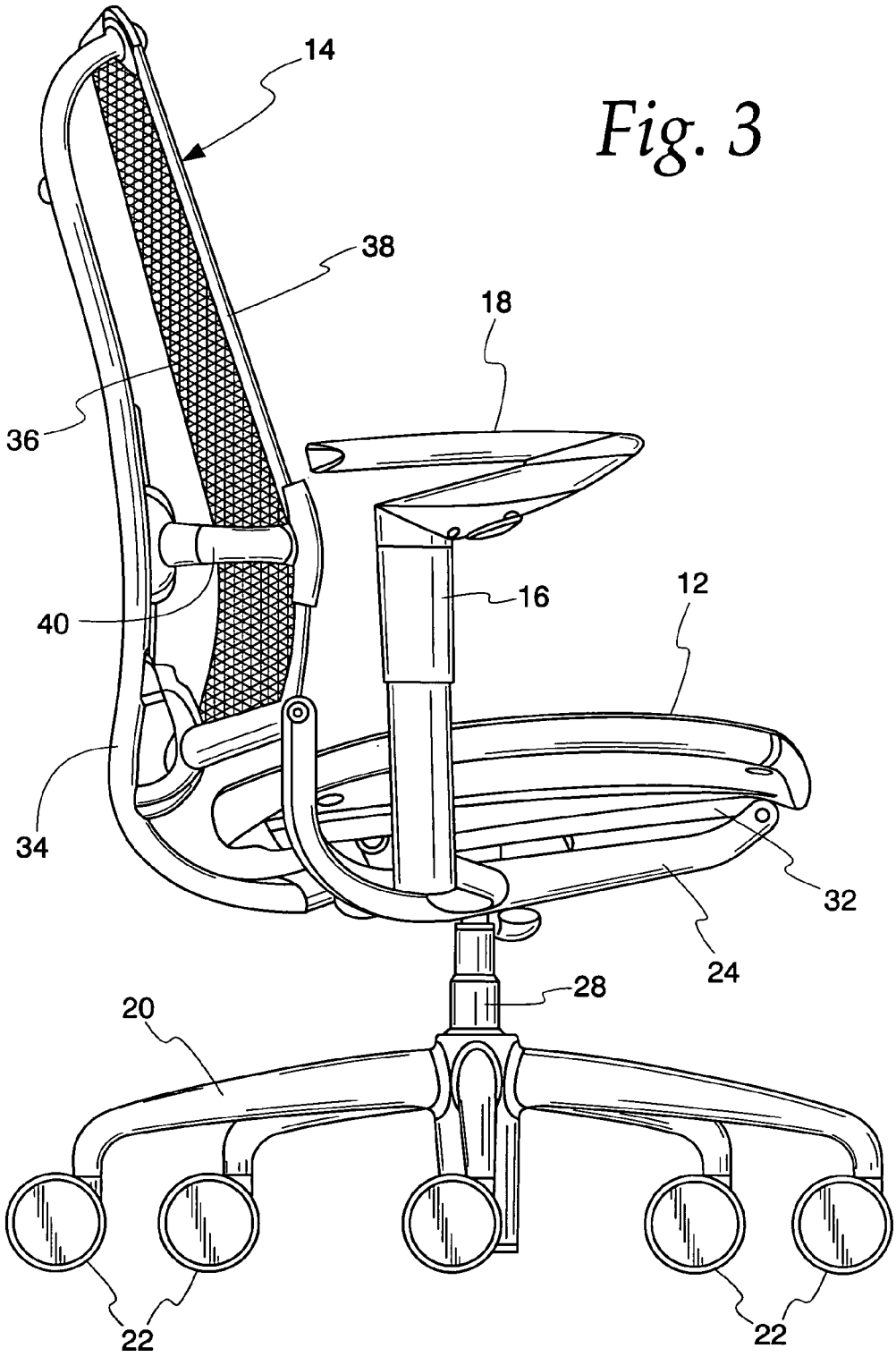
FIG. 3 is a right side view thereof.
Figure 4:
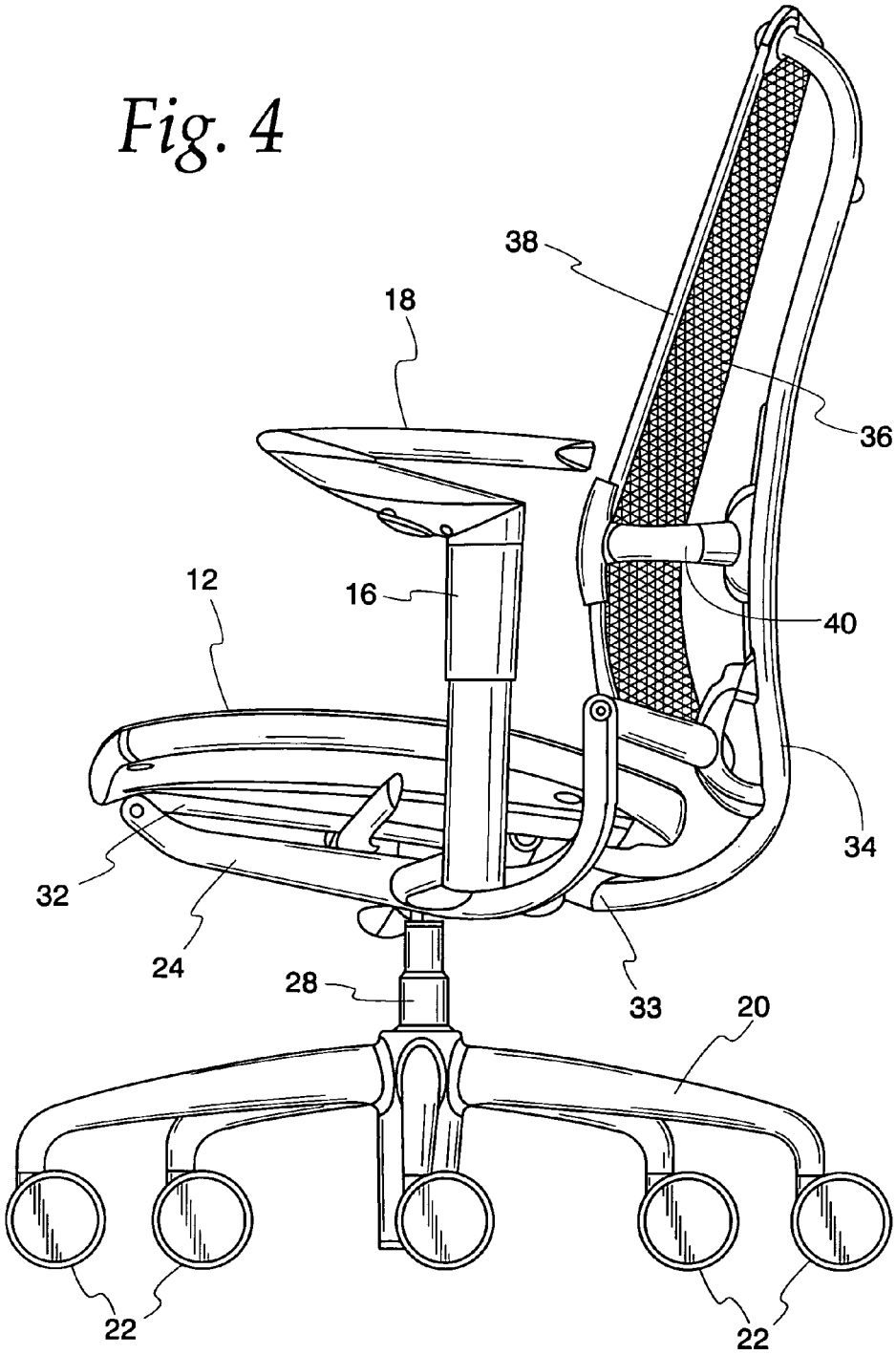
FIG. 4 is a left side view thereof.
Figure 5:
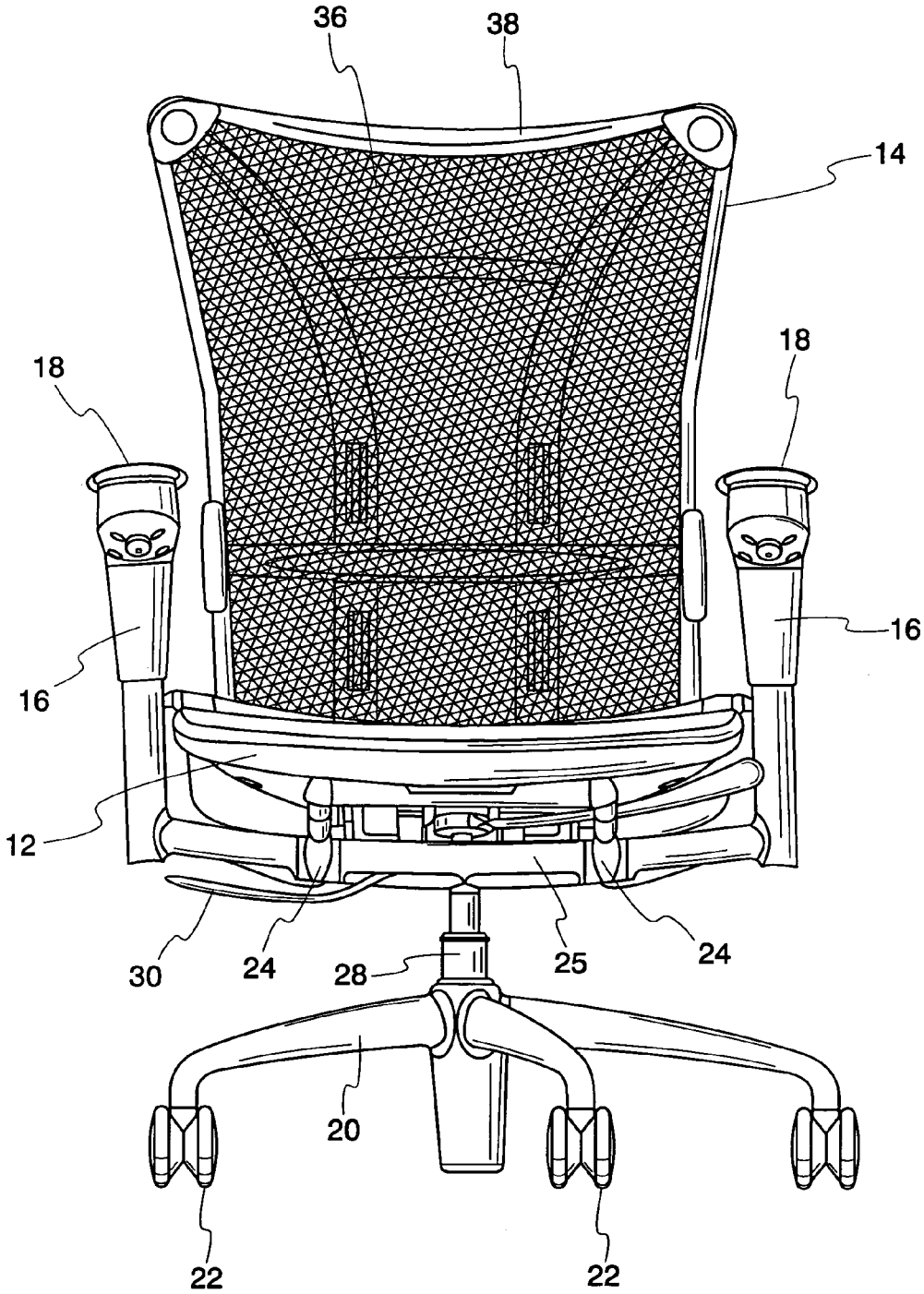
FIG. 5 is a front view thereof.
Figure 6:
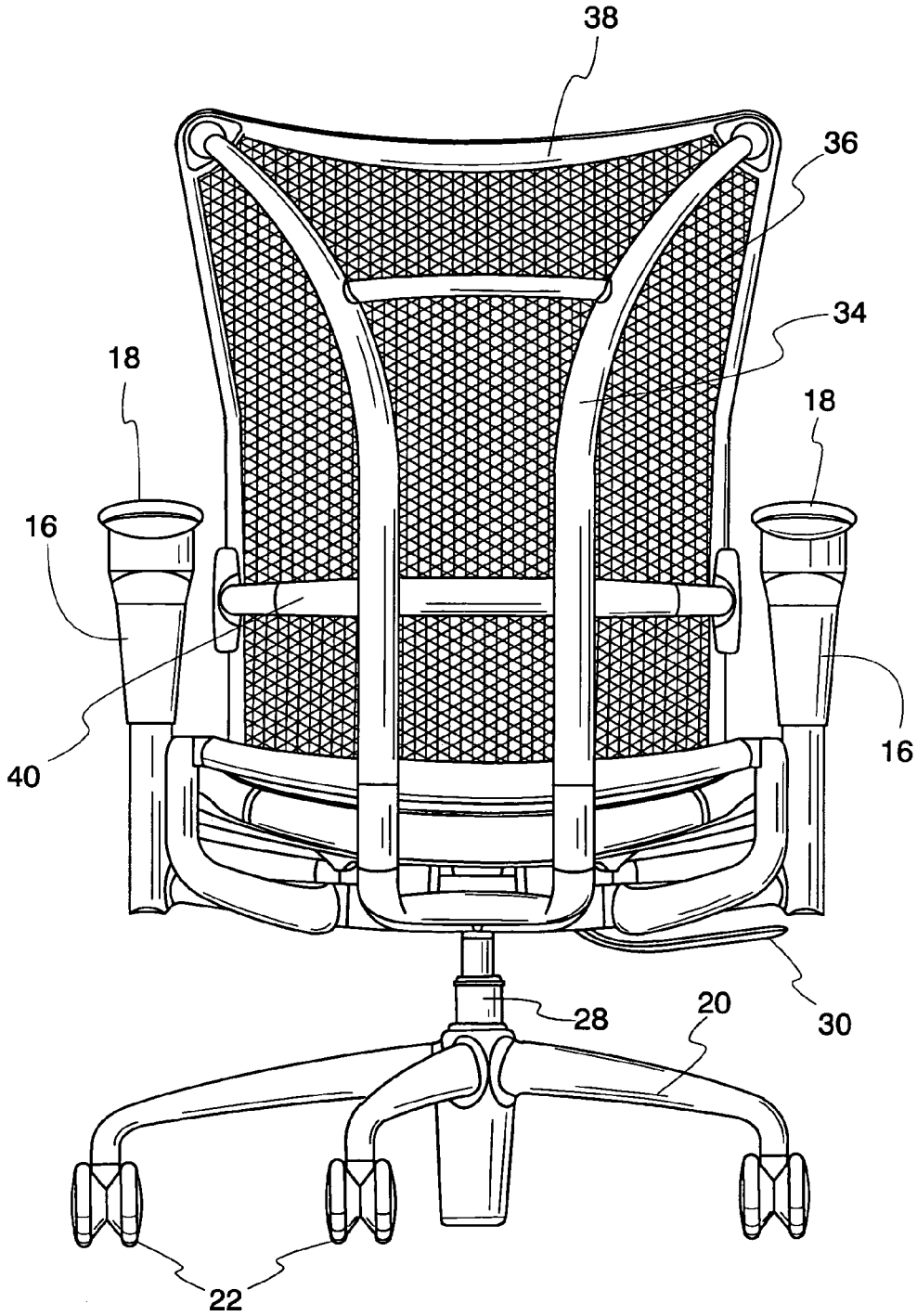
FIG. 6 is a rear view thereof.
Figure 7:
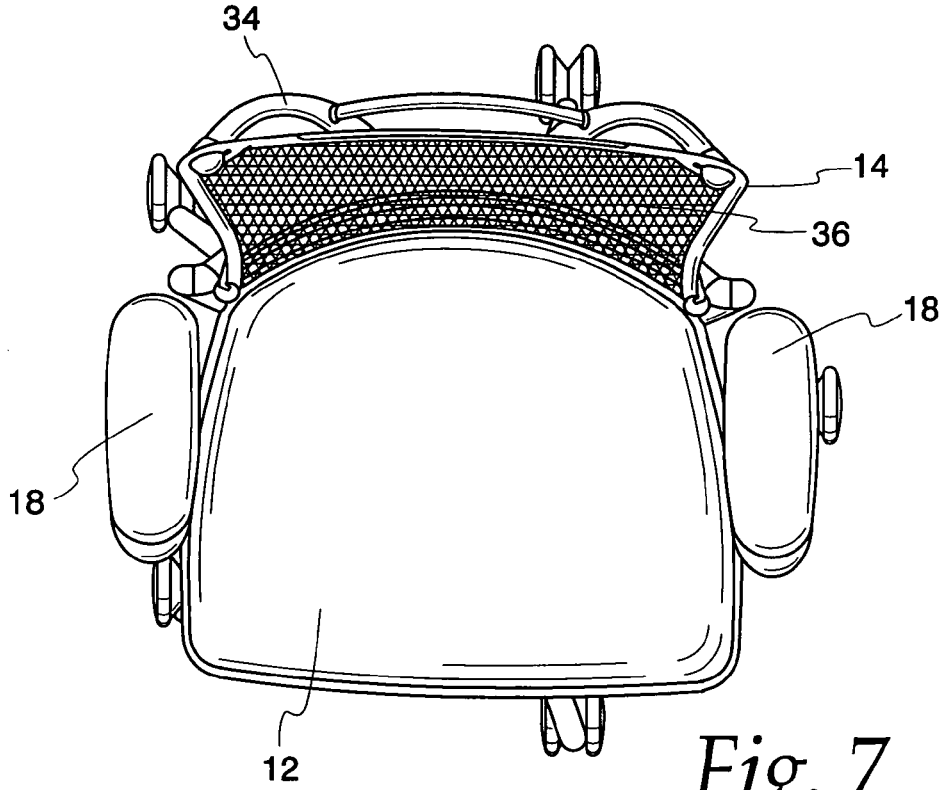
FIG. 7 is a top view thereof.
Figure 8:
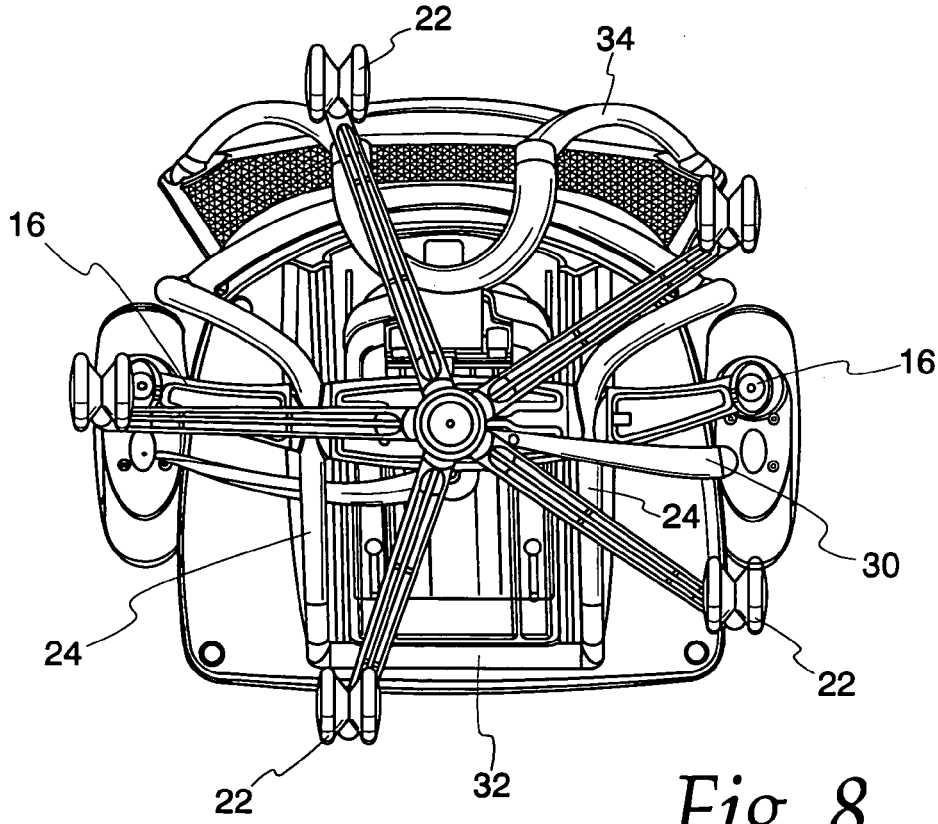
FIG. 8 is a bottom view thereof.
Figure 9:
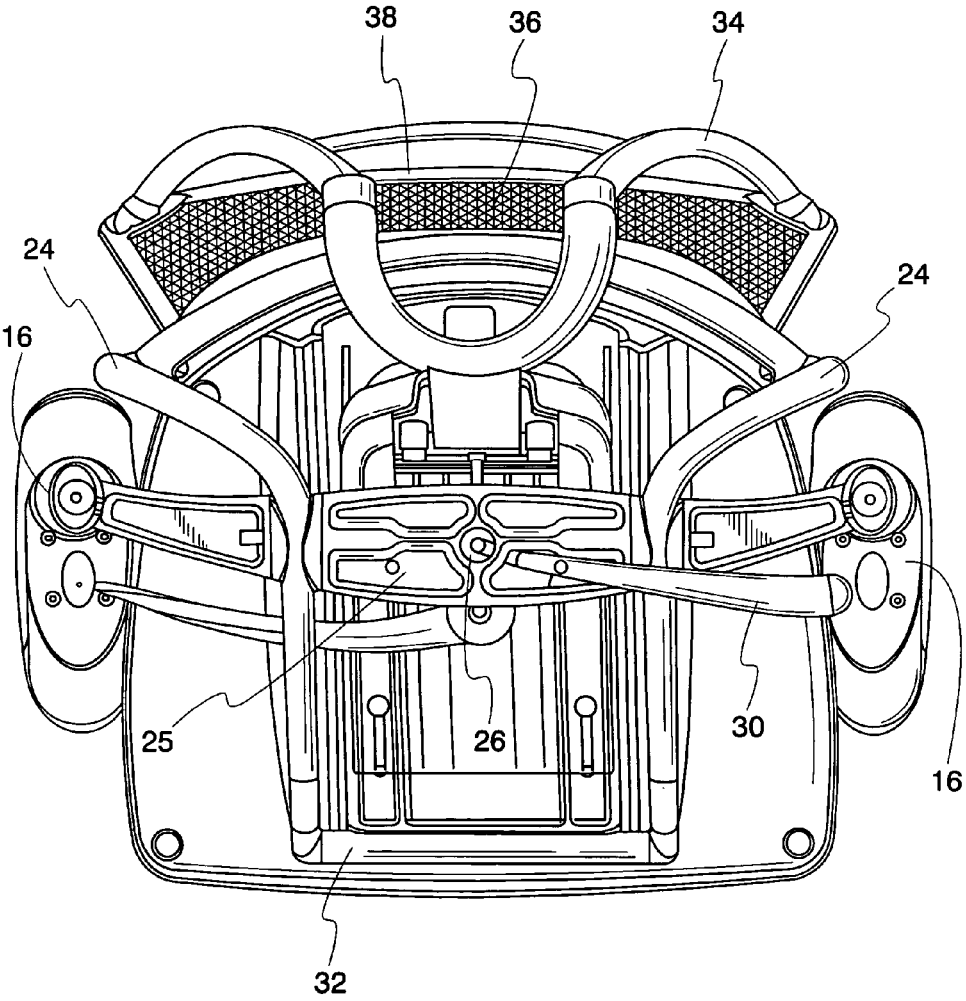
FIG. 9 is a bottom view thereof with the chair base removed.
Figure 9A:
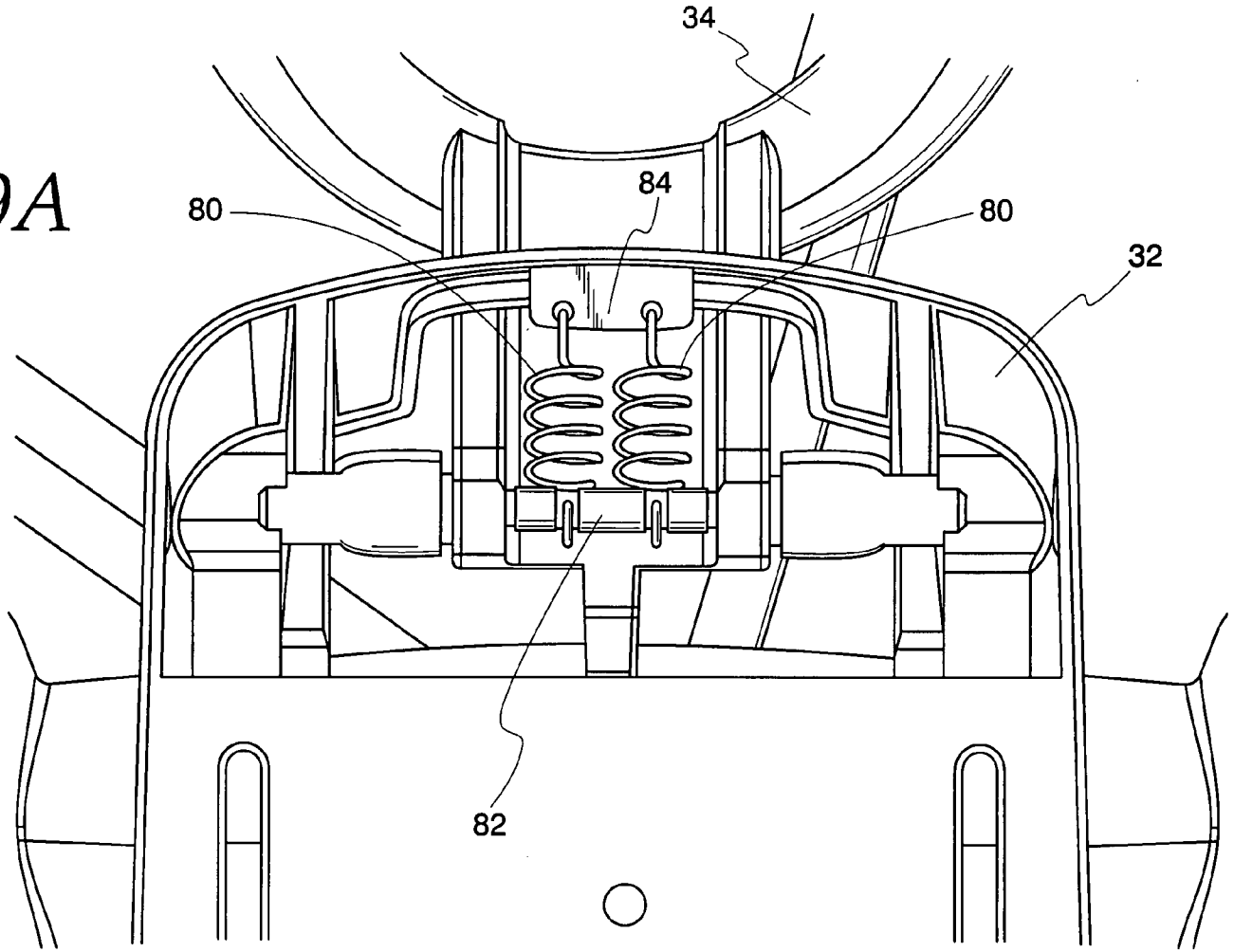
FIG. 9*a* is a bottom plan view of the chair without a central support module.

Referring now to the drawings, and initially to FIGS. 1, 2 and 2*a*, an improved ergonomic chair constructed in accordance with the numerous principles disclosed in the above identified patent applications is shown in front perspective and designated generally by the reference numeral 10. The chair 10 comprises as its principal components a seat 12 and back 14. Suitable arms 16 having upper pads 18 may be provided. The chair 10, in a conventional manner, may be supported on a spider base 20 movable on casters 22.

As shown in FIGS. 3–9, the chair 10 is so constructed as to have synchronous movement of the seat 12 and back 14. To this end, a pair of main seat and back supports 24 are rigidly attached to a central support module 25 having a hub 26 for frictionally receiving the upper end of a gas cylinder 28. The gas cylinder 28 is preferably a two-stage type available from Stablis GmbH of Germany. This cylinder 28 is operable by a manually pivotable lever 30 which activates the cylinder 28 for height and adjustability of the chair 10 in a manner well-known in the art. The chair arms 16 are rigidly connected to the supports 24. A seat pan 32 is pivotably connected at its front end to the forward end of the supports 24. A support back frame assembly 34 is also pivotably connected to the upper rear of the supports 24. The chair back 14 in the preferred embodiment is of fabric mesh 36 construction supported around its periphery by a carrier 38. An adjustable lumbar support member 40 slidably connects to the carrier and bears against the back support assembly 34.

Figure 10:
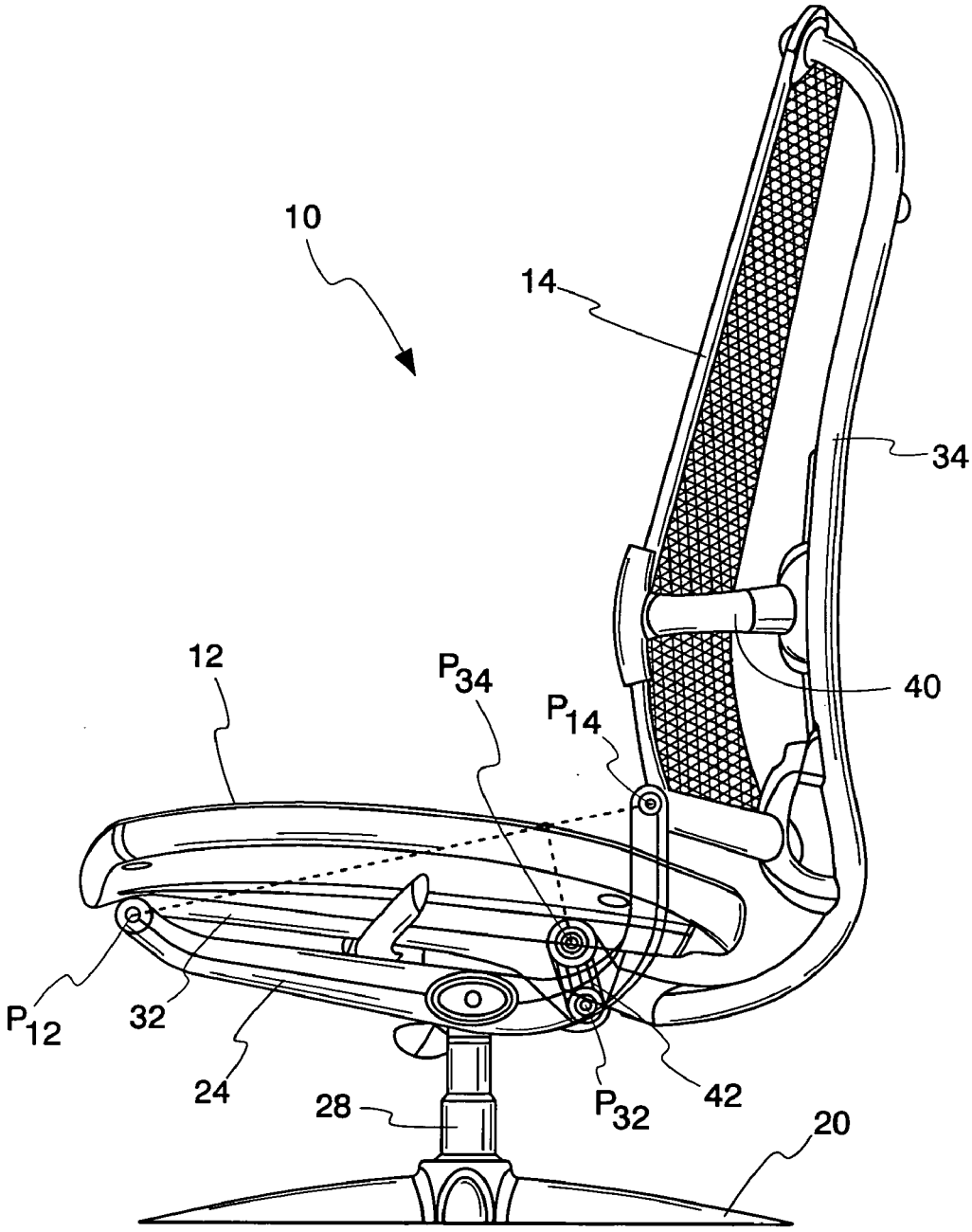
FIG. 10 is a partial left side view illustrating the chair in a fully upright position.
Figure 10A:
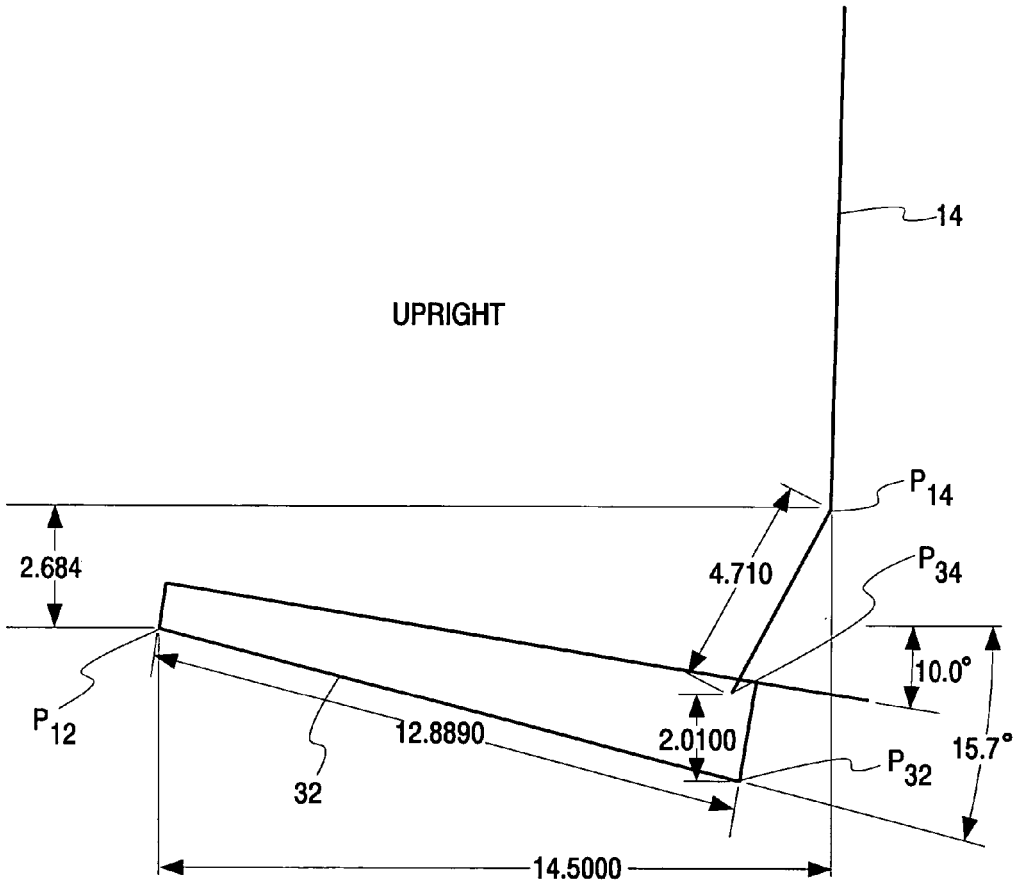
FIG. 10*a* is a diagrammatic elevation view of the chair illustrating pivot points.
Figure 11:
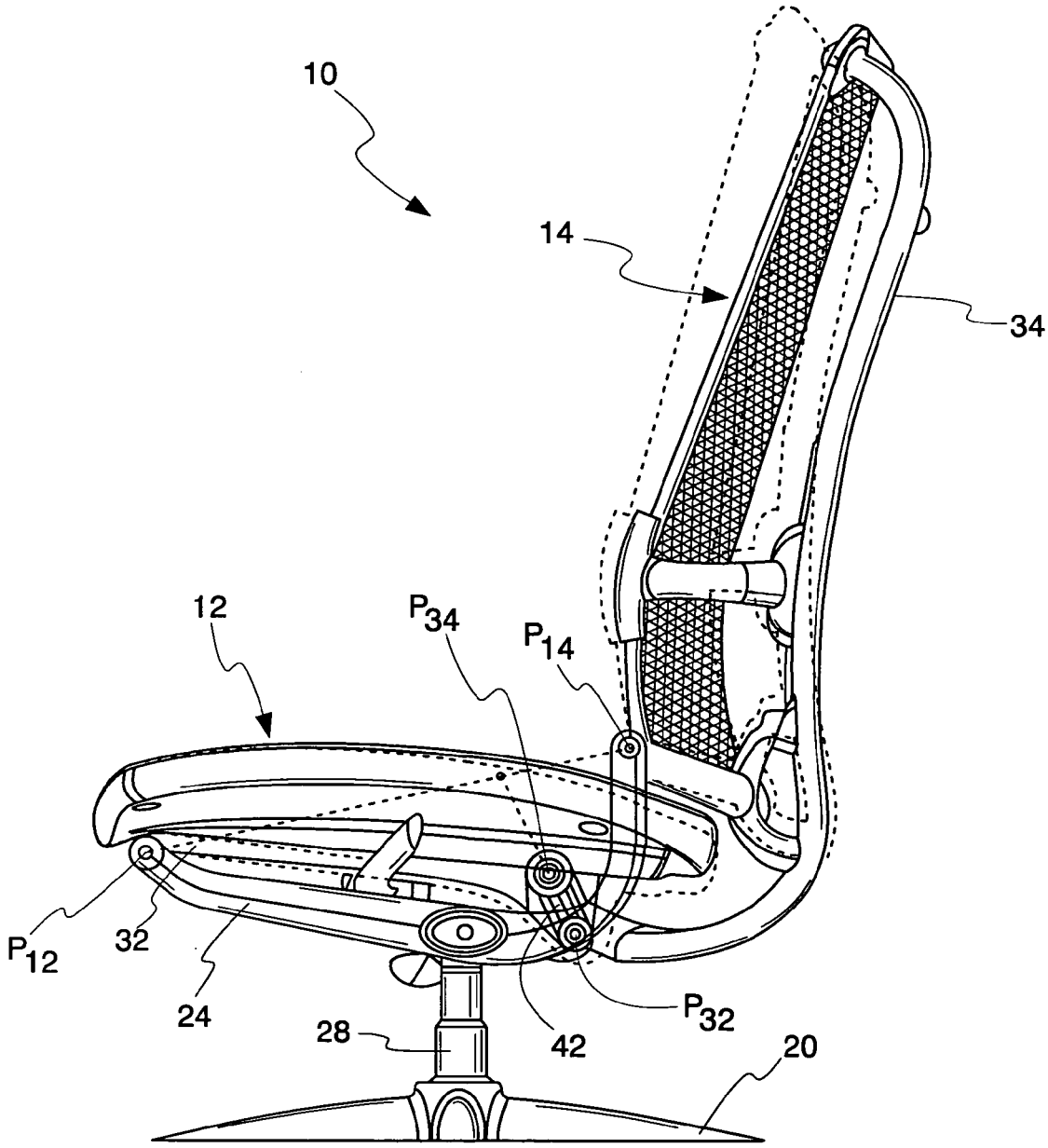
FIG. 11 is a partial left side view of the chair shown in a partially reclined position.
Figure 12:
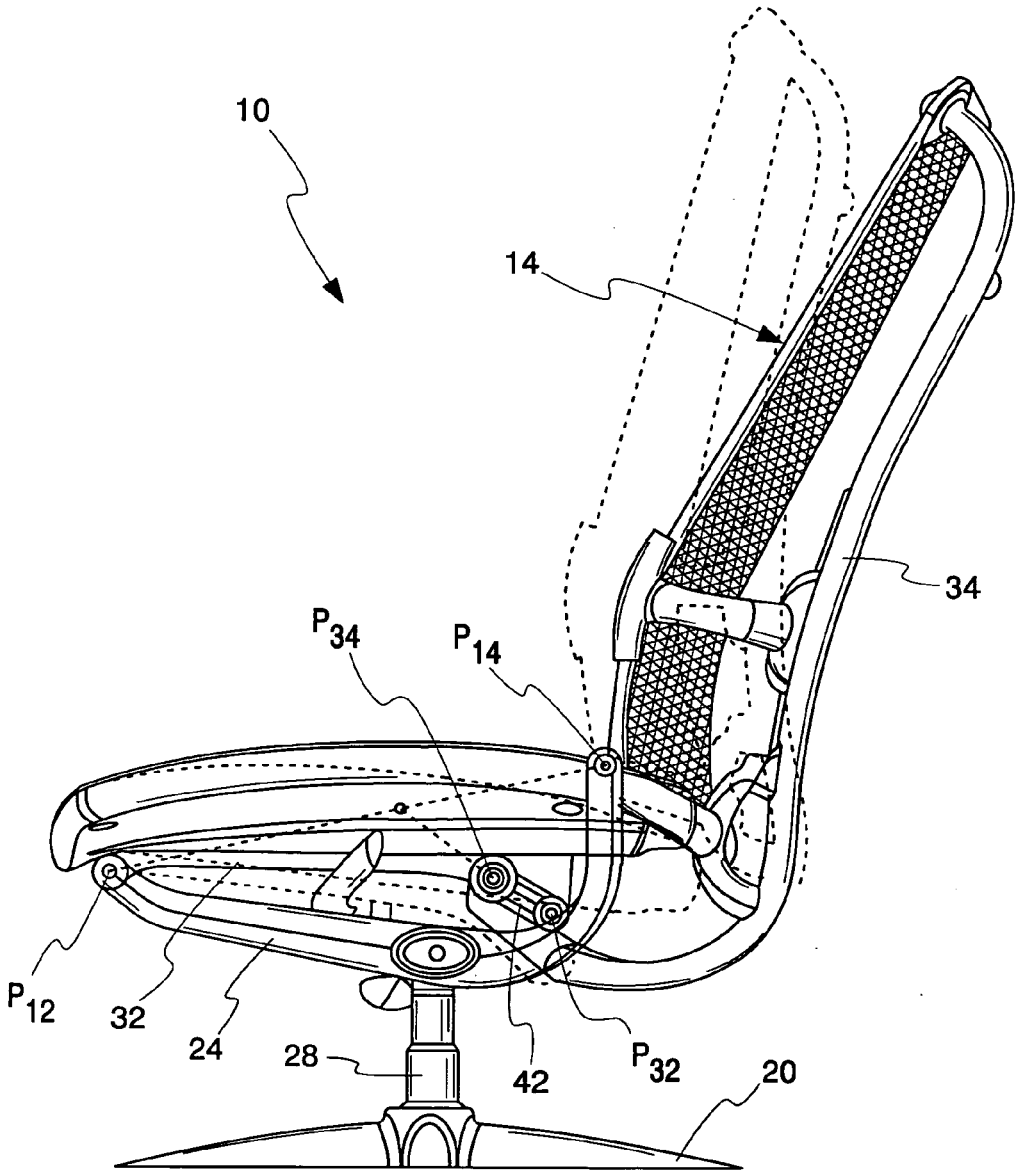
FIG. 12 is a partial left side view of the chair shown in a fully reclined position.
Figure 12A:
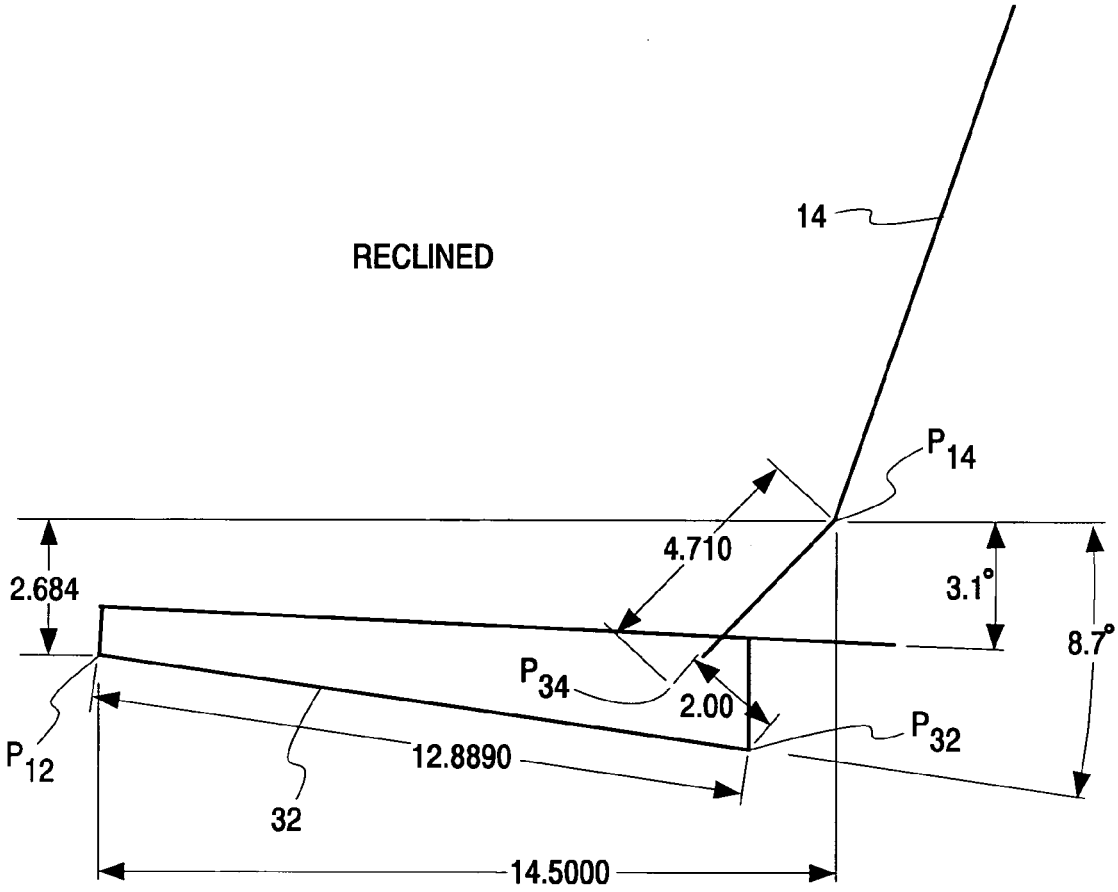
FIG. 12*a* is a diagrammatic elevation view of the chair showing the pivot points when the chair is in a reclined position.

The relative portions of the seat 12 and back 14 of the chair 10, during reclining of the back 14, can be seen in the side views of FIGS. 10–12. As illustrated in these views, the chain seat pan 32 is pivotably connected at pivot points $P_{12}$ to the supports 24 (only one of which can be seen) and is pivotably connected at rear pivot points $P_{32}$ to a pair of links 42 (only one of which can be seen). Each link 42 in turn is pivotably connected at point $P_{34}$ to forward extensions of the back frame assembly 34. The back frame assembly 34 is also pivotably connected at point $P_{14}$ to the two supports 24. As shown in the three stages of back tilt illustrated in FIGS. 10–12, as the back 14 reclines rearwardly, the link 42 moves in a counterclockwise direction of rotation causing the rear of the seat pan 32 to elevate relative to its front. This synchronous motion of the seat pan 32 and back 14 provides for an exceptionally comfortable reclining motion of the chair 10 user to aid in avoiding fatigue as the user is performing various work-related tasks.

Figure 13:
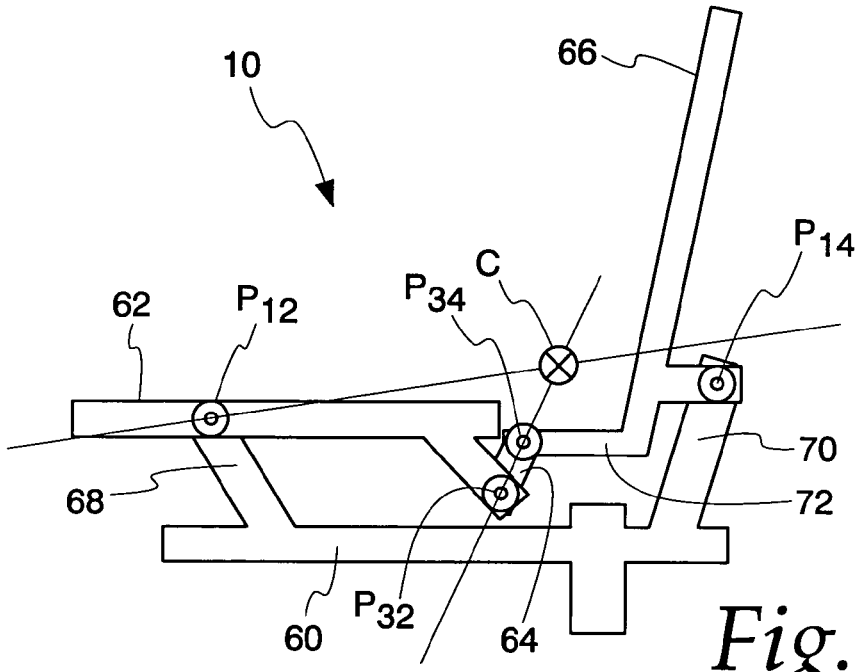
FIG. 13 is a side schematic view showing the linkage arrangement of the chair.
Figure 14:
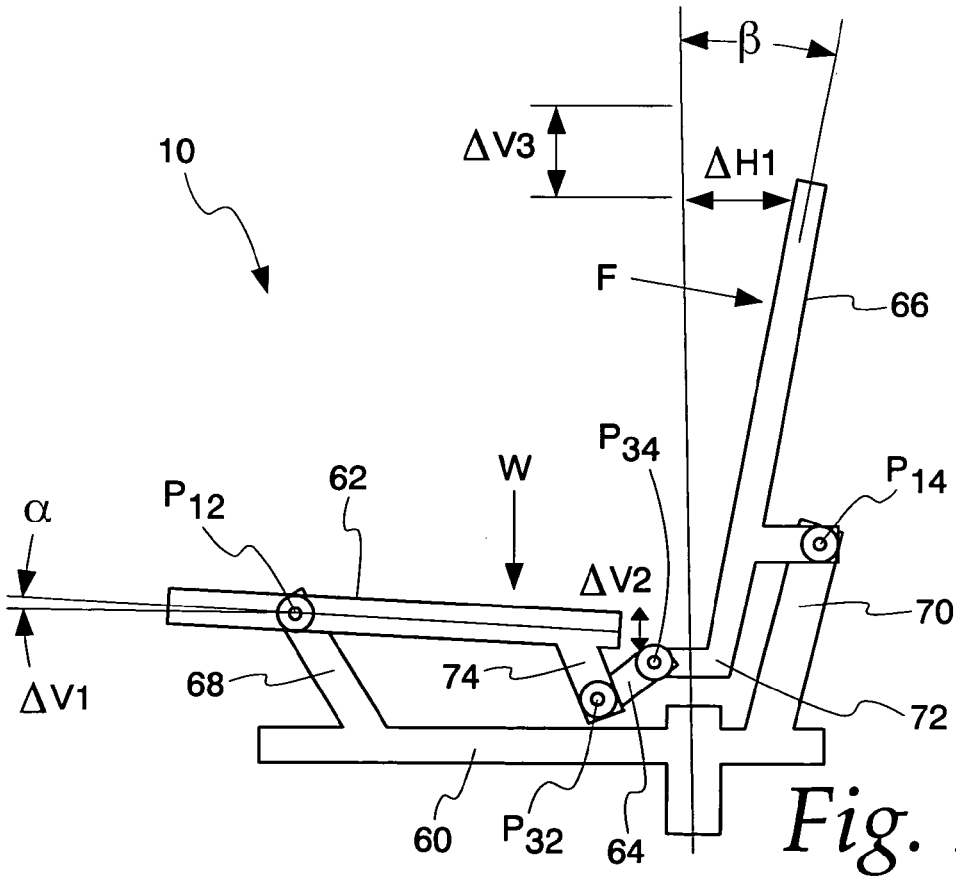
FIG. 14 is a side schematic view showing the kinematics of the chair.

Shown now in FIGS. 13 and 14 are schematic views of the synchronous seat and back tilt feature employing a four-bar mechanism which allows the rear of the seat to elevate as the backrest is reclined. The mechanism is designed to immediately respond to a user exerting a back force and/or self-weight on the seat. This function allows for reclining of the chair 10 about a rotation point C that is very closely coincident with the pivot axis of the user's hips and avoids undesirable "shirt pull" of the user. Because the rear of the seat is elevated during back reclining, excess pressure is relieved at the front underside of the user's thighs, and also a relatively constant gaze angle is maintained during reclining. This provides for adequate fluid circulation in the user's legs and avoids swelling. To accomplish the foregoing advantages, the chair 10 comprises four basic members and four rotationally-free pivots. The basic members include a floor supported member 60, a seat rest 62, a linking member 64 and a backrest 66. The floor supported member 60 has an upwardly directed portion 68 that terminates at an end defining pivot point $P_{12}$ to which the seat rest 62 is pivotably connected at its forward portion. The member 60 also has an upwardly directed portion 70 which terminates at an end defining pivot point $P_{14}$ to which the backrest 66 is pivotably connected. A lower portion 72 of the back rest 66 is pivotably connected at point $P_{34}$ to the linking member 64 and a downwardly extending portion 74 of the seat rest 62 is pivotably connected at point $P_{32}$ to the other end of the linking member 64.

The kinematics of the chair 10 are illustrated in FIG. 14. As force F is applied on the backrest 66, the back tilt angle β increases, eye location shifts backwards an amount ΔDH1, and eye elevation decreases by an amount ΔDV3. The change in back tilt angle β transmits motion by way of the upper and lower back pivots $P_{14}$ and $P_{34}$, respectively, to the linking member 64. As a result of motion set in linking member 64, the rear seat pivot $P_{32}$ moves in coordination with pivot $P_{34}$ in a composite rotational and translation motion. As the seat rest 62 rotates about pivot $P_{12}$, a lift ΔDV2 is caused in the rear part of the seat rest 62 relative to its front edge ΔDV1 in the amount ΔDV2-ΔDV1, therefore introducing a seat rest angle α. The user sitting in the chair will feel a weight reduction effect as a result of the lift. The apparent weight reduction will be sensed as lightness and give the feel of comfort.

It can now be appreciated that a chair 10 constructed according to the invention offers considerable advantages in user comfort by virtue of its synchronous linkage construction particularly where it is used for prolonged periods of time. The chair 10 is also cost effective to manufacture and assemble.

Figure 15:
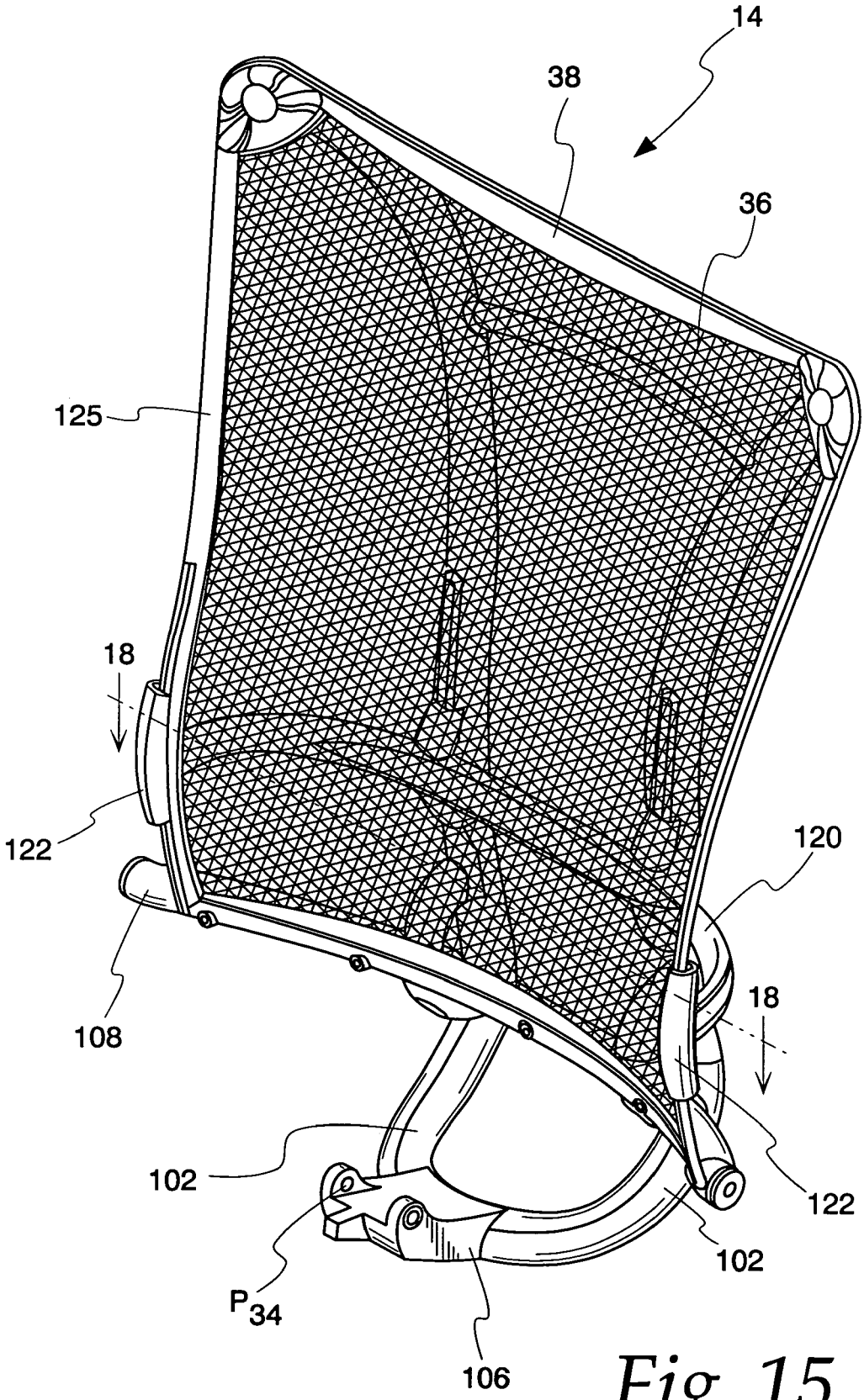
FIG. 15 is a front perspective view of the chair back assembly.
Figure 16:
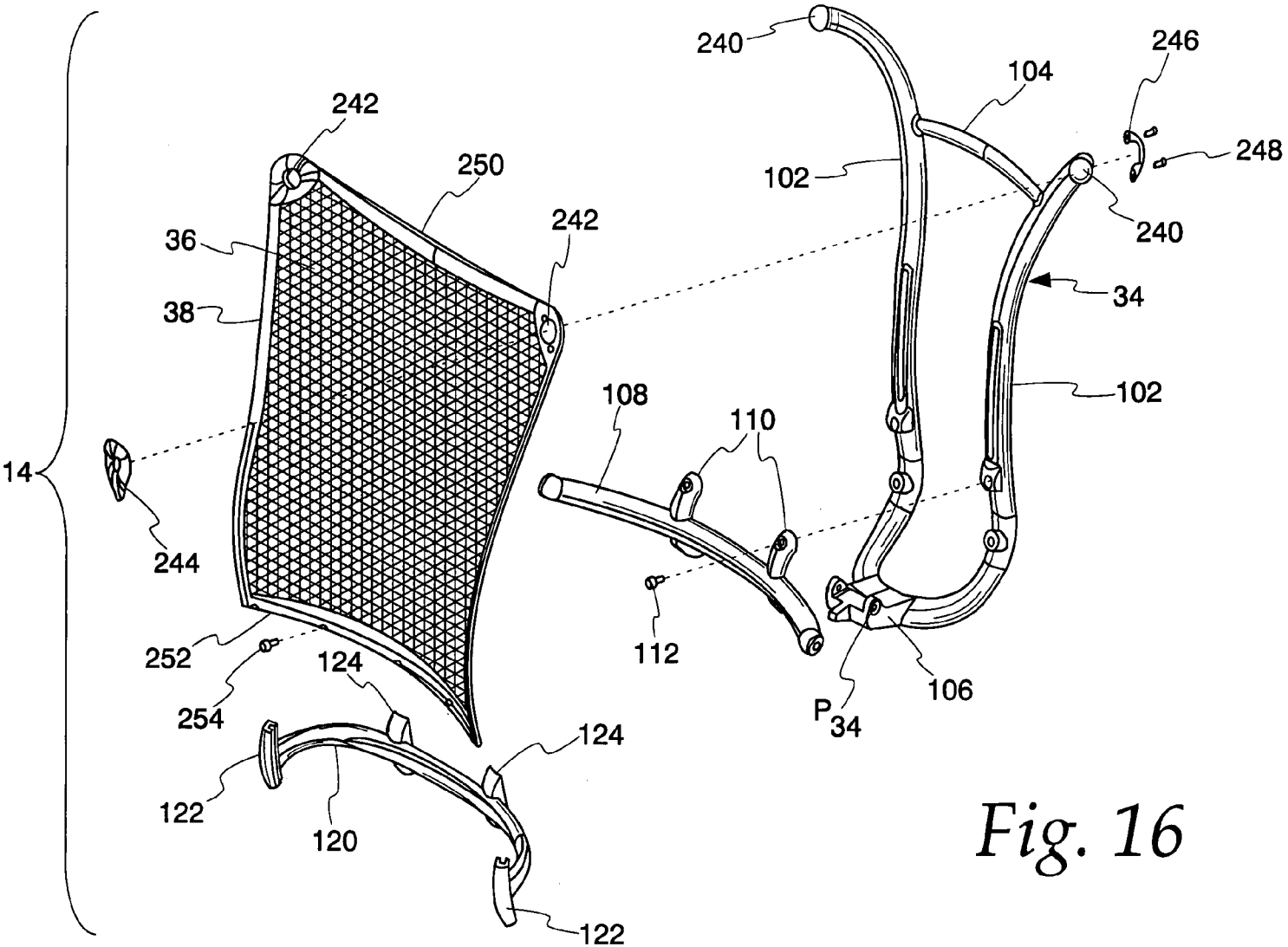
FIG. 16 is an exploded perspective view thereof.

Turning now to FIGS. 15 and 16, the complete back 14 of the chair is illustrated in perspective and shows the novel feature of the lumbar support construction. As earlier noted, the chair back 14 comprises a fabric mesh material 36 supported around its periphery by a semi-rigid bendable carrier 38. Main back frame member 34 consists in preferred form of two generally vertical supports 102 connected proximate their upper ends by a brace 104. The bottom ends of the supports 102 bend inwardly and terminate at a forwardly projecting member 106 which serves to provide aforementioned pivot point $P_{34}$. Transverse member 108 is provided with a pair of spaced arms 110 which are attached as by screws 112 to the two supports 102. The member 108 provides a lower attachment point for the carrier 38.

Figure 17:
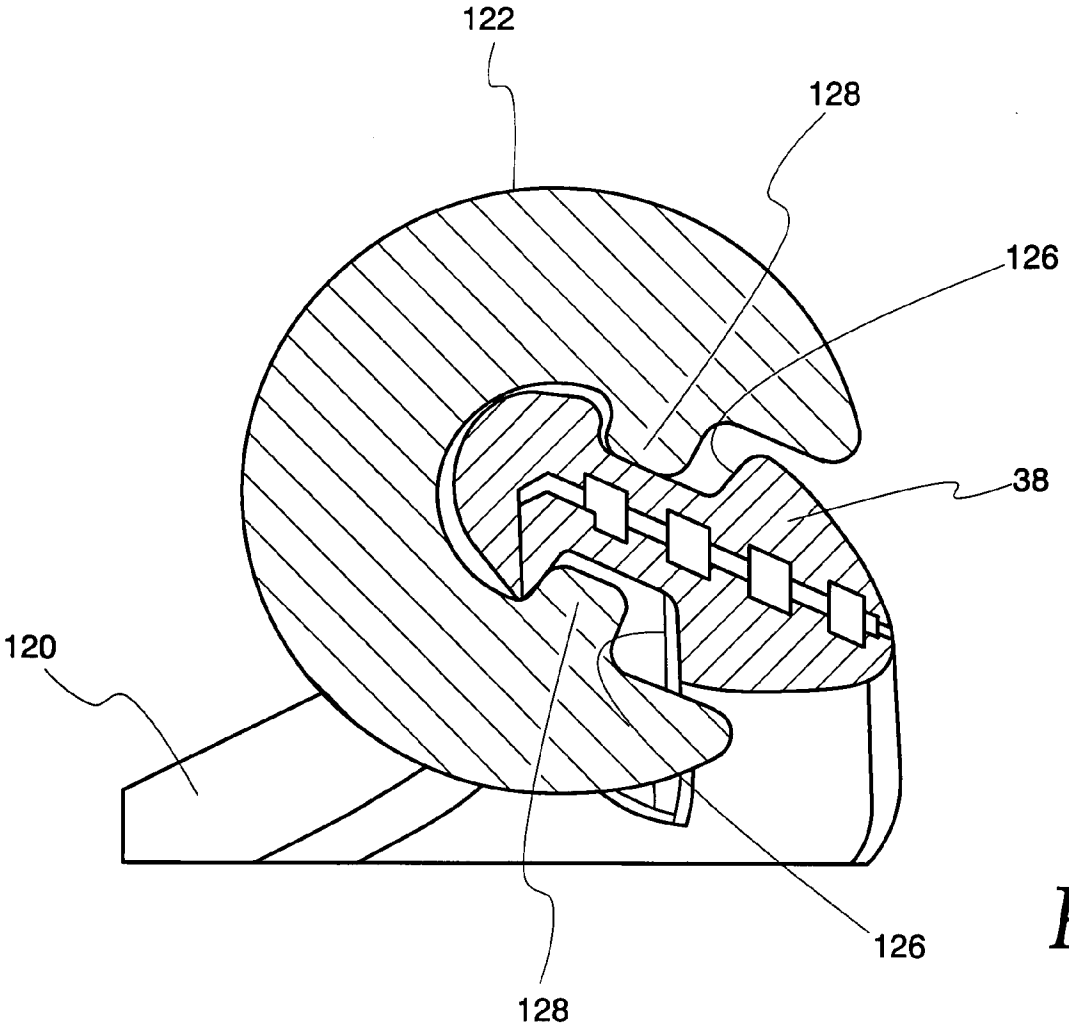
FIG. 17 is a cross-sectional view taken substantially along the line 17—17 of FIG. 15.

In accordance with the invention the back assembly 14 includes a transverse lumbar support tube 120 having gripping means 122 on each of its opposed ends, together with a pair of spaced slide members 124. A cross-section of the gripping means 122 can be seen in FIG. 17 wherein the carrier 38 is provided with a pair of opposed recesses 126 into which opposed projections 128 of the gripping means 122 are slideably received. Thus, the support tube 120 is slideable on opposed edges of the carrier 38.

Figure 18:
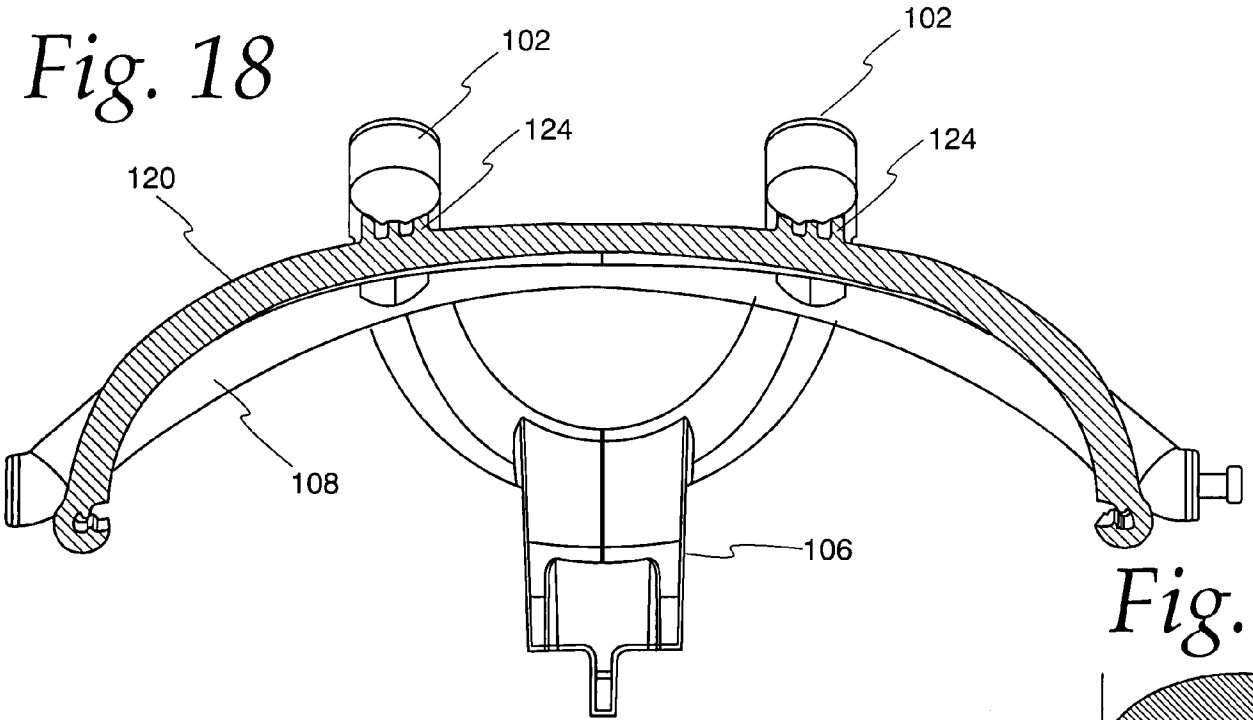
FIG. 18 is a cross-sectional view taken substantially along the line 18—18 of FIG. 15.
Figure 19:
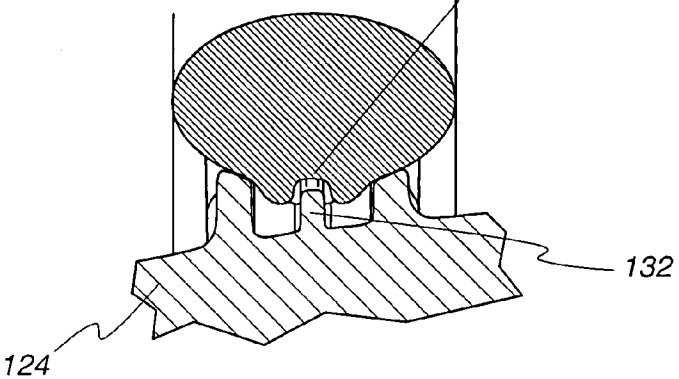
FIG. 19 is a cross-sectional view taken substantially along the line 19—19 of FIG. 15.
Figure 20:
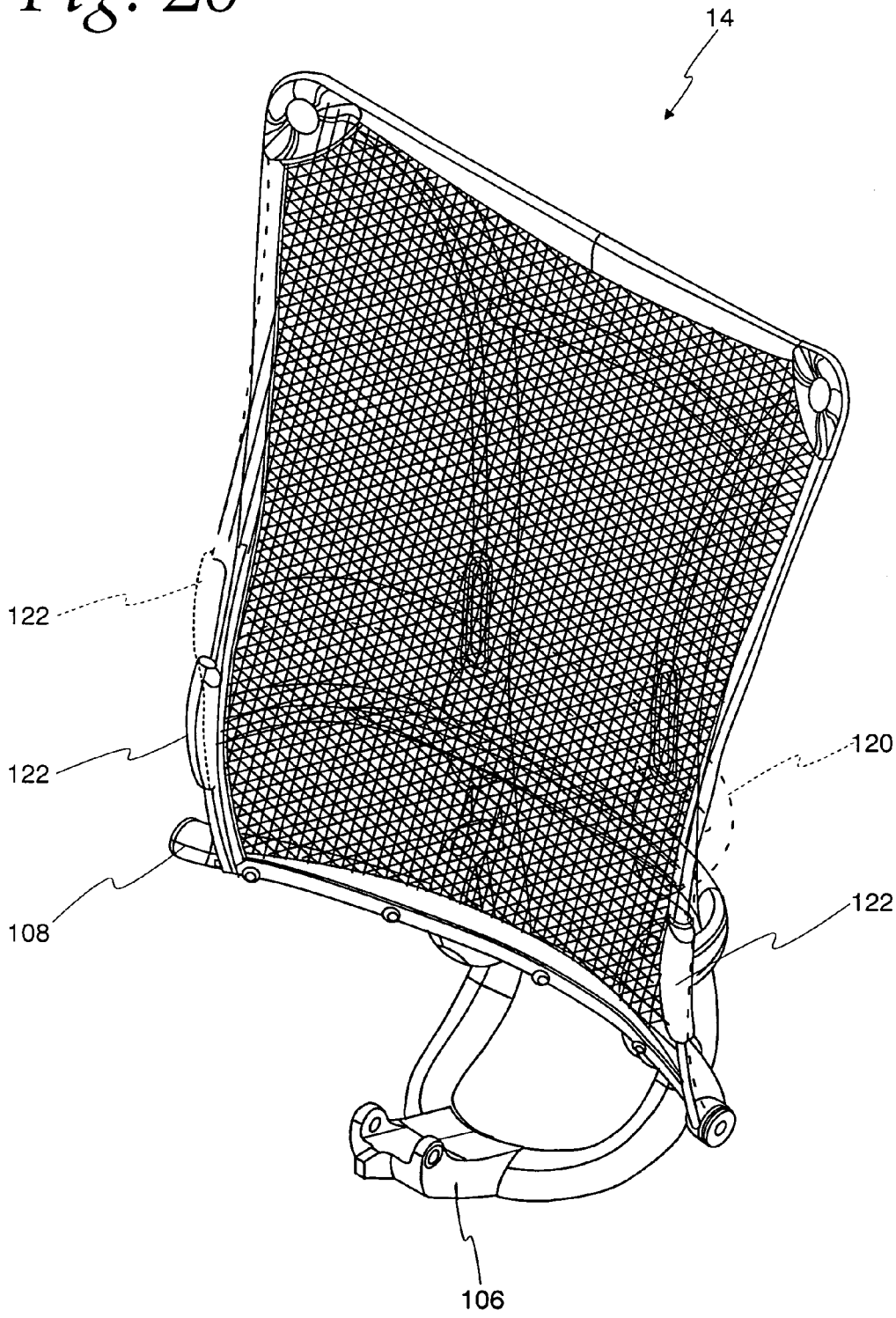
FIG. 20 is a perspective view of the chair back illustrating the adjustability of the lumbar support.

FIG. 18 illustrates a cross-sectional view of the support tube taken substantially along the line 18—18 of FIG. 15. There, it can be seen that slide members 124 are configured to engage vertical supports 102. As shown in FIG. 19, the engagement arrangement of the slide members 124 includes a simple vertical grooves 130 in the supports 102 by means of a central rib 132. It can now be appreciated, particularly with reference to FIG. 20, that the lumbar support tube 120 is vertically moveable between upper and lower positions as it slides on edges of the carrier 38 by means of the gripping means 122 and also slides on the vertical supports 102 by means of the slide members 124. The result of such movement is to allow the chair 10 user to adjust the vertical height of the tube 120 by simply manual manipulation. The tube 120 is held in proper connection to the supports 102 by just the tension of the carrier 38 and mesh 36. In this tension mode the tube 120 causes the carrier 38 and mesh to be forced forwardly of chair 10 in the lumbar region of the user.

Figure 22:
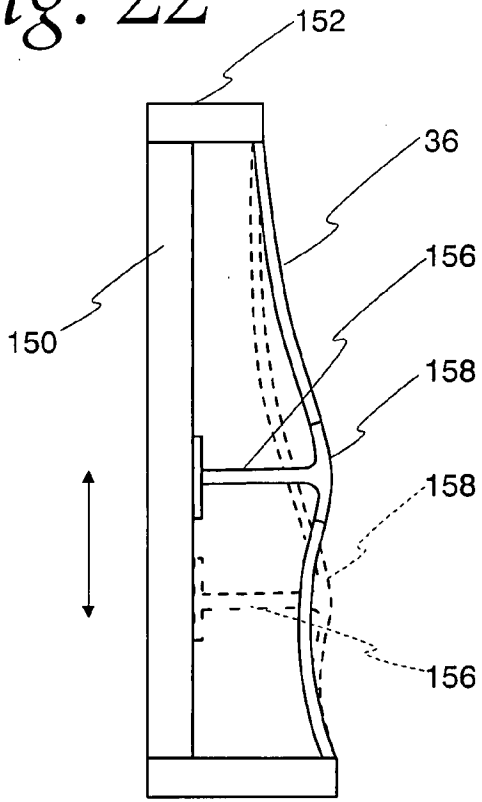
FIGS. 21–30 illustrate alternative constructions for the lumbar support.
Figure 21:
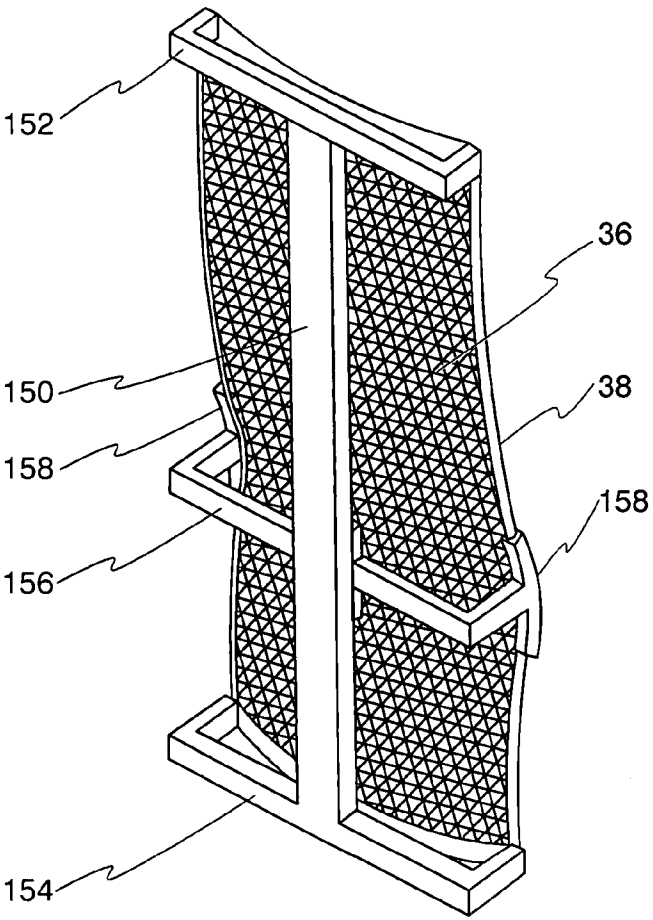

Alternative lumbar support systems using the mesh 36 and carrier 38 assembly can be seen in FIGS. 21–30. In FIGS. 21 and 22, it can be seen that a single central support 150 may be employed having top and bottom braces, 152 and 154, respectively, to secure the four corners of the carrier. A lumbar support tube 156 may be slideably supported on the central support 150 and have gripping means 158 for slideably gripping opposed edges of the carrier 38.

Figure 24:
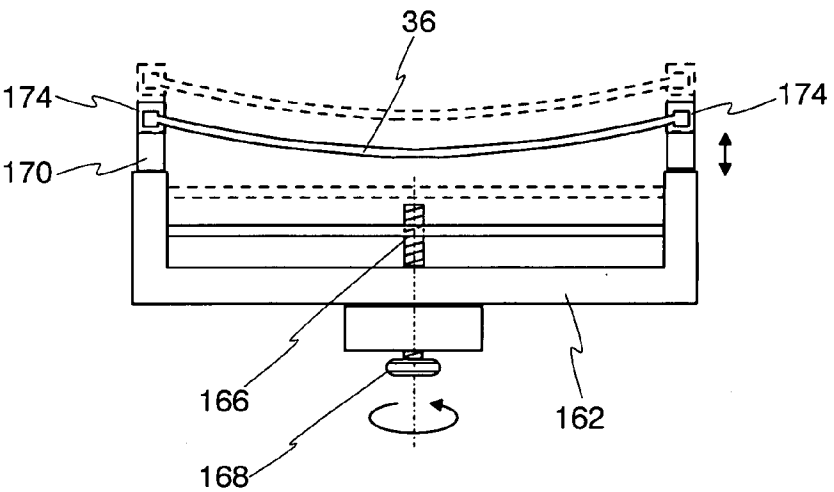
Figure 23:
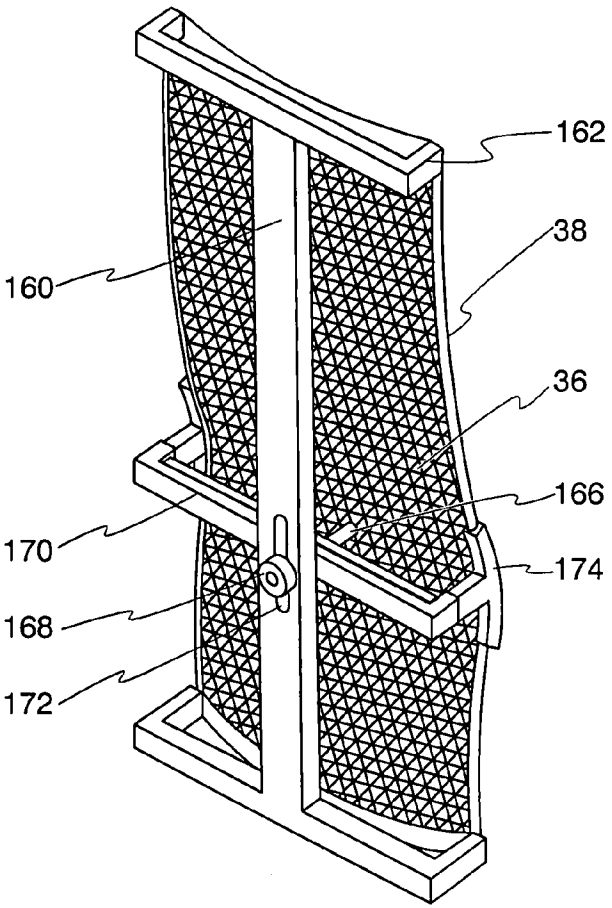

In FIGS. 23 and 24, a system is shown wherein a central support '60 and upper and lower braces, 162 and 164, respectively, a threaded rod 166 and knob 168 are employed to selectively move a lumbar support member 170 forwardly and rearwardly to adjust tension in the mesh 36. The system may also be constructed with a slot 172 through which the rod 166 passes to vertically adjust the member 170 as it slides on the carrier 38 using gripping means 174 as described above.

Figure 26:
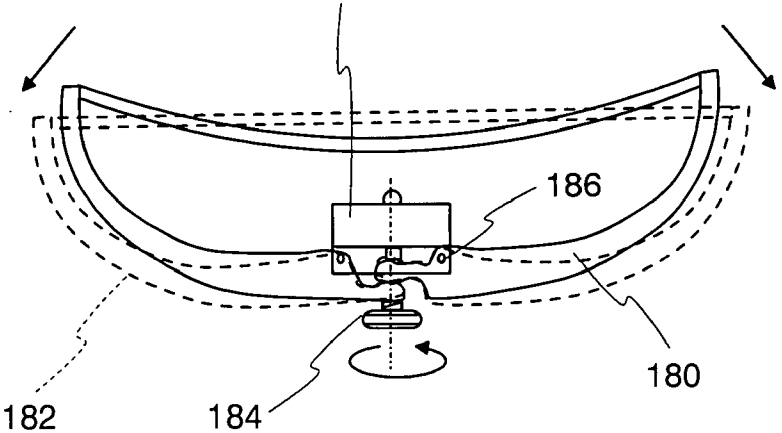
Figure 25:
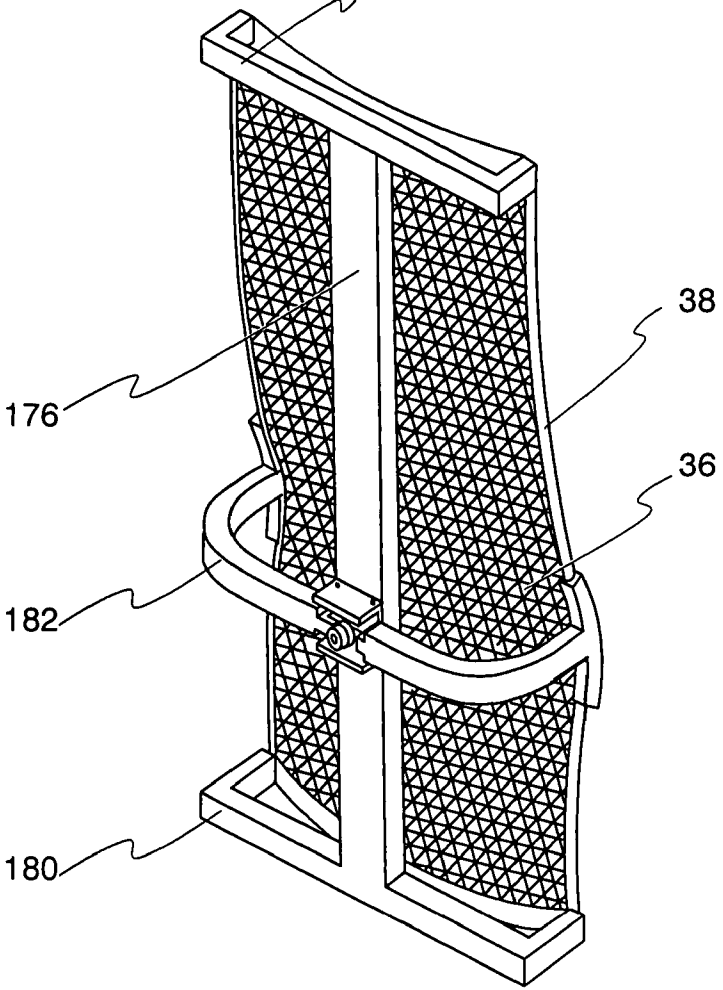

FIGS. 25 and 26 illustrate an embodiment wherein a central support 176 and braces 178 and 180 and braces 178 and 180 are used. However, a two piece lumbar support member 182 is employed to adjust tension in the mesh 36 by means of a manually rotatable knob 184 and camming device 186.

Figure 28:
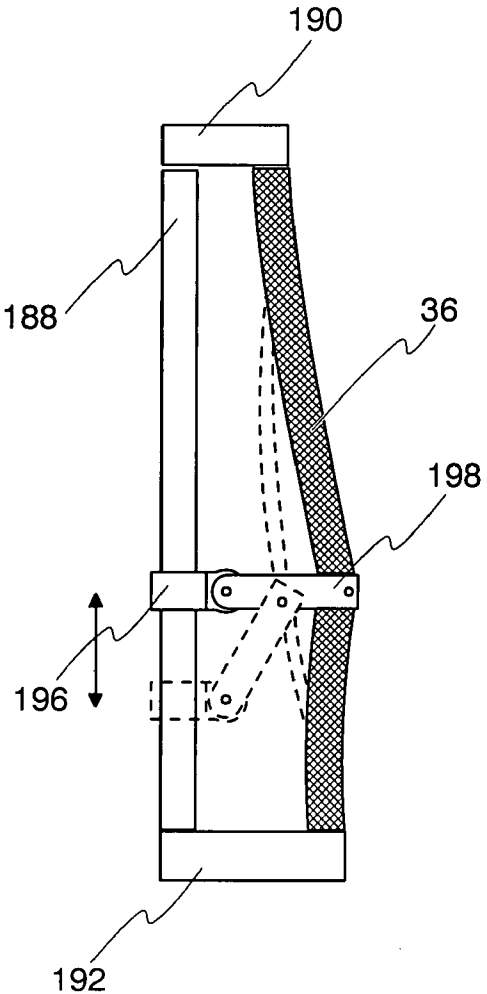
Figure 27:
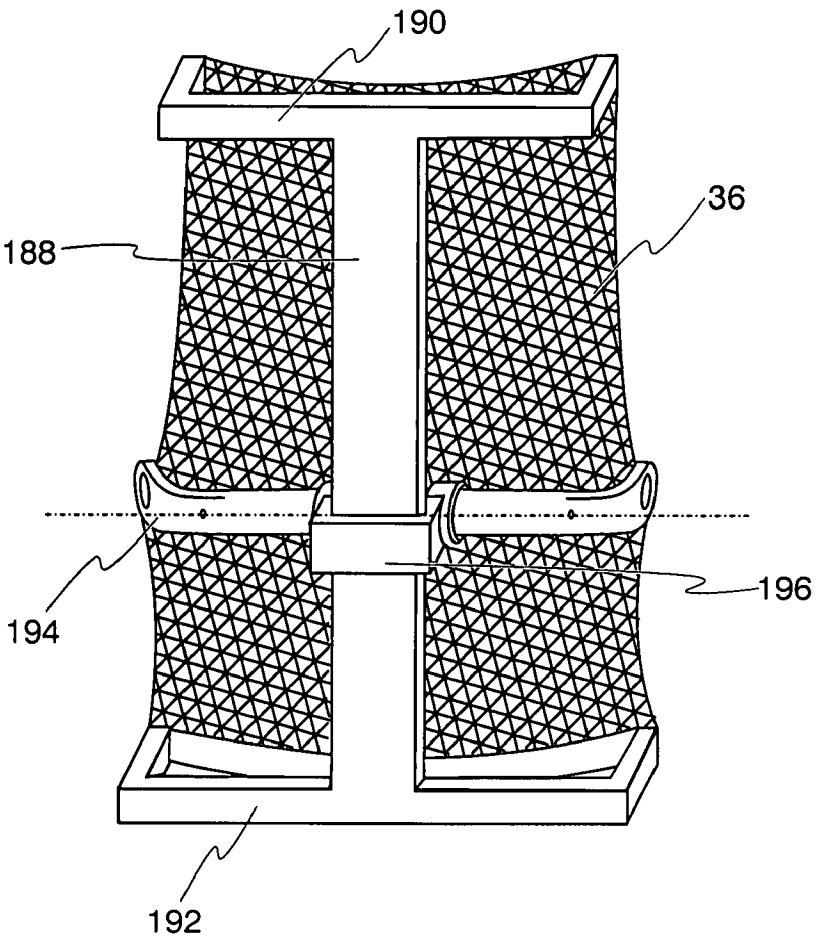

FIGS. 27 and 28 show yet another embodiment wherein a central support 188 and braces 190 and 192 are used. However, in this construction a lumbar support member 192 is connected by a slideable bracket 194 to the support 188 and uses a link member 196 to adjust tension in the mesh 36.

Figure 30:
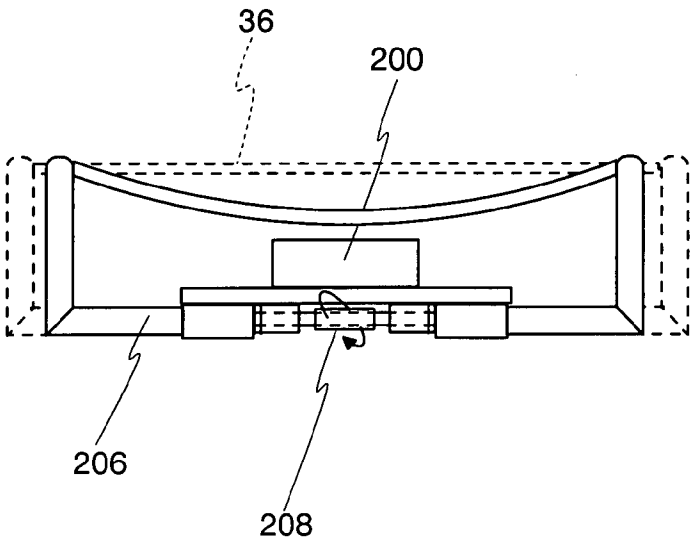
Figure 29:
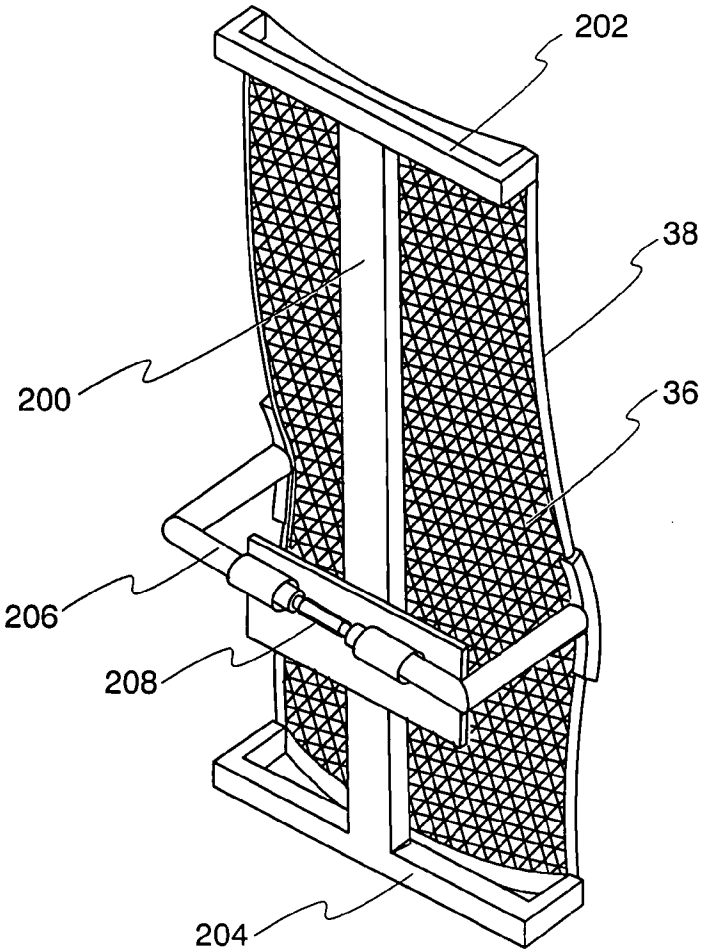

FIGS. 29 and 30 show a further embodiment wherein a central support 198 and braces 200 and 202 as used. In this construction a two piece lumbar support member 204 is employed using a turnbuckle assembly 206 to adjust tension in the mesh 36.

Figure 31:
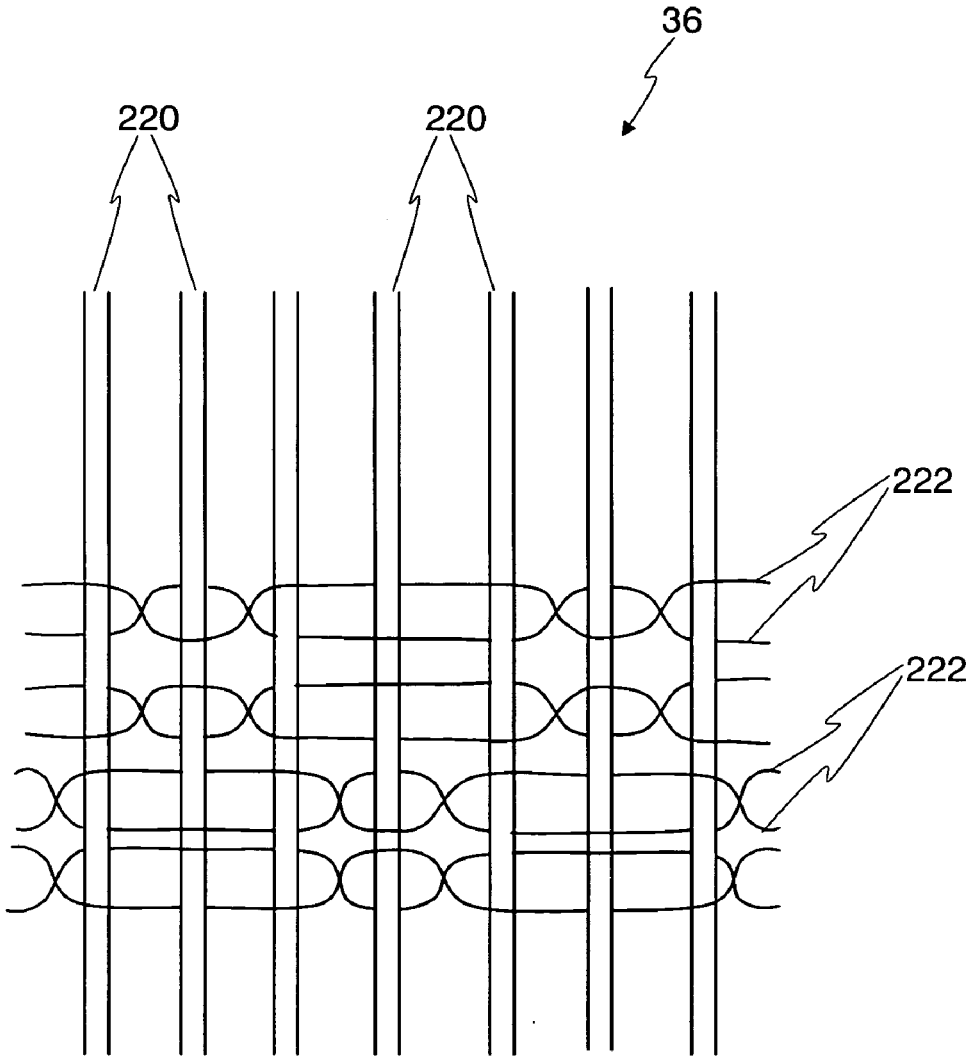
FIG. 31 is an enlarged plan view of a portion of fabric mesh suitable for use in the present chair back construction.

Yet another novel and highly functional feature of the chair 10 that offers ergonomic advantages over the prior art is the construction of the chair back 14. As previously noted, the back 14 is designed to be formed of a panel of fabric mesh 36 which is preferably of an open weave type known in the art. The construction of the fabric mesh 36 may have a variety of weave configurations. One configuration that has proved to be advantageous is shown in FIG. 31 comprising vertical strands 220 of multifilament yarn and horizontal monofilaments 222. The monofilaments 222 in this construction can be seen to cross over the strands 220 and also crisscross over each other thereby locking the strands 220 in place.

Figure 32:
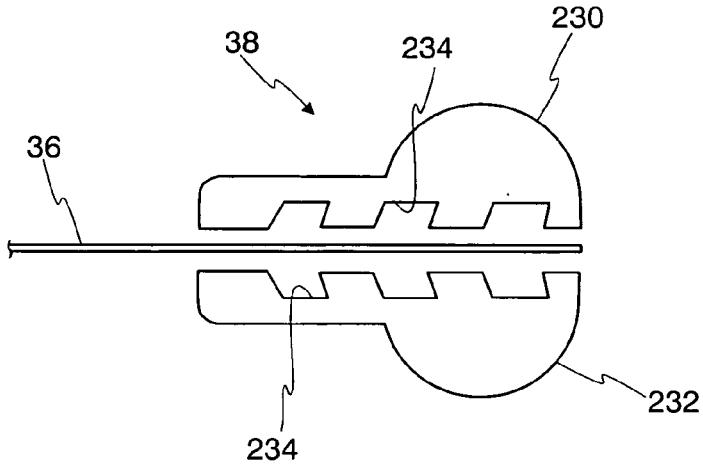
FIG. 32 is a cross-sectional view of one form of the carrier and mesh attachment system.
Figure 33:
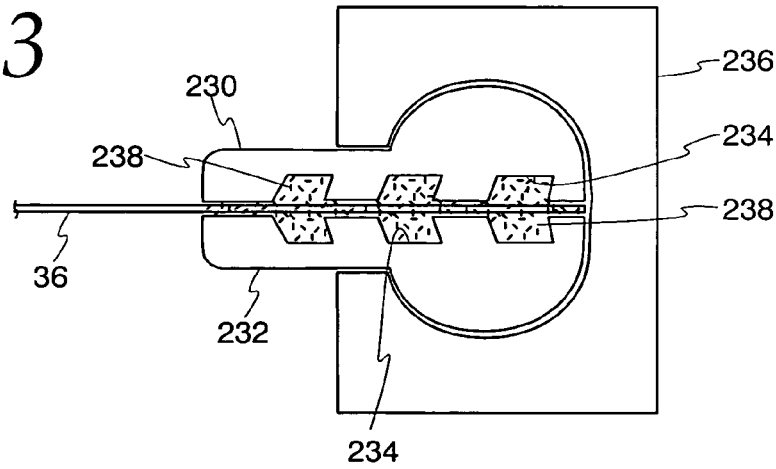
FIG. 33 is another cross-sectional view of the carrier and mesh attachment system.

In order to support the mesh 36 around its edges, the aforementioned carrier 38 is used. The physical connection of the carrier 38 to the mesh 36 may be performed in a number of ways. However, a most reliable connection is disclosed in U.S. Pat. No. 6,511,562. FIGS. 32 and 33 illustrate a carrier 36 comprising two halves 230 and 232 disposed on opposite sides of the edge portion of mesh 36. The two halves 230 and 232 may, in one form, be formed with internal grooves 234. The halves are placed in a fixture 236 together with an adhesive 238. The adhesive extends through warps and wefts of the fabric 36 and into pockets formed by the grooves 234 and, once cured, creates a mechanical interconnection that is of high strength and durability.

Figure 34:
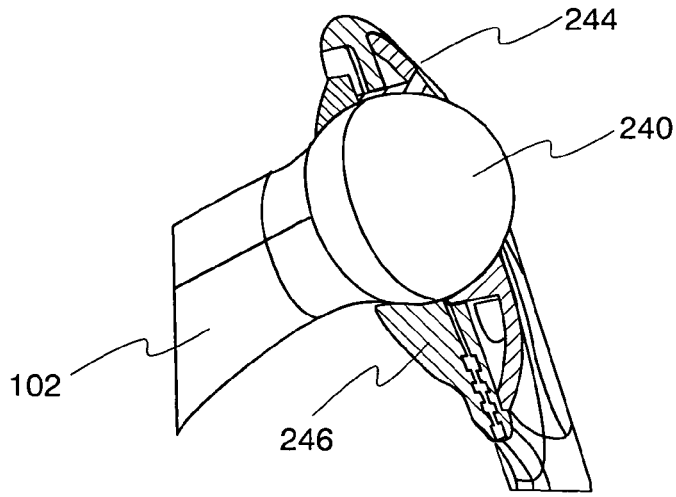
FIG. 34 is a cross-sectional view of the upper attachment construction of the chair back.
Figure 35:
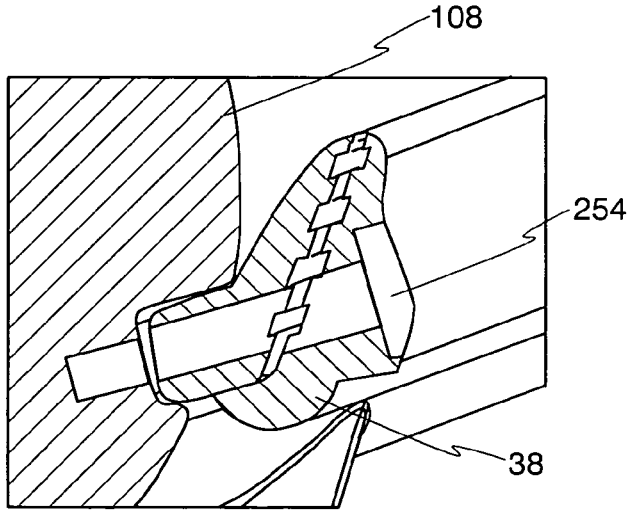
FIG. 35 is a cross-sectional view of the bottom attachment construction of the chair back.

In order to support the chair back 14, in accordance with the invention and referring once again to FIG. 16 the main back frame assembly 34 has spherical end portions 240 formed on vertical support members 102 which are received within circular apertures 242, FIG. 16, formed in the upper right and upper left hand corners of the carrier 38. Suitable retainers 244 and 246, one on each side of the carrier 38, are attached as by screws 248 around each spherical end portion 240 to essentially create ball and socket joints. These joints allow upper edge 250 of the carrier 38 to flex allowing the chair back 14 to comfortably conform to the position of the user's shoulders. The back may be secured along bottom edge 252 to the frame member 108 by screws 254. Details of the upper ball and socket connections may be seen in the cross-sectional view of FIG. 34, while the lower attachment construction can be seen in detail in FIG. 35.

It can now be appreciated that a chair back construction as just described offers considerable ergonomic advantages. The use of open mesh 36 allows the chair back 14 to not only breathe, but to flex in conformity with the back of the user. The back 14 is also highly cost effective to manufacture and assemble.

The above specification describes in detail several preferred embodiments of the present invention. Other examples, embodiments, modifications and variations will under both the literal claim language and the doctrine of equivalents come within the scope of the invention defined by the appended claims. Still other alternatives will also be equivalent as will many new technologies. There is no desire or intention here to limit in any way the application of the doctrine of equivalents nor to limit or restrict the scope of the invention.

The invention claimed is:

1. A chair with a support structure for a seat and a back, said chair comprising:

a frame structure extending generally upwardly from the support structure;

a back structure mounted on said frame structure, said back structure including a flexible material for supporting the back of a chair user;

a lumbar support structure slidably mounted to each of said frame structure and said back structure whereby said flexible material is spaced apart from said frame structure, said lumbar support structure affecting the flexibility of said flexible material at the vertical position along said frame structure and said back structure where said lumbar support structure is positioned thereby enabling the relocation of the position where the effective lumbar support is provided to the back of the chair users; and said frame structure including an upper portion with two spaced arms wherein each of the two spaced arms comprise an extended end portion connected to said back structure.

2. The chair of claim 1 wherein said back structure has a front portion and a rear portion; and said lumbar support structure extends laterally and is spaced from the rear portion of said back structure and engages vertically extending edges of said back structure.

3. The chair of claim 1 wherein said back structure comprises a flexible frame containing said flexible material therein; and said lumbar support structure engages said flexible frame of said back structure.

4. The chair of claim 3 wherein said lumbar support structure alters tension of the flexible material of said back structure.

5. The chair of claim 1 wherein said movable lumbar support structure restrains movement of said flexible material of back structure.

6. The chair of claim 5 wherein said lumbar support structure engages lateral edges of said back structure.

7. The chair of claim 1 wherein said back structure is connected to said frame structure only at a bottom edge of said back structure and at two locations in an upper portion of said back structure.

8. The chair of claim 7 wherein said upper portion of said back structure includes discrete spaced apart locations for attachment to said frame structure.

9. The chair of claim 1 wherein said back structure is connected to said frame structure only at a bottom edge of said back structure and at two locations in an upper portion of said back structure.

10. The chair of claim 9 wherein said back structure includes a bendable peripheral carrier and a center portion of flexible fabric.

11. A chair back for an office chair wherein the office chair includes a base, a plurality of casters connected to said base, a vertically adjustable column mounted to said base, a support structure mounted to swivel on said vertically adjustable column, a seat assembly connected to said support structure, and a back assembly connected to said support structure, said office chair having a forward portion, a rearward portion, a left side portion and a right side portion, said side portions defining a lateral direction, said forward and rearward portions defining a longitudinal direction and moving between said base and said seat assembly defining a vertical direction, the chair back comprising:

said back assembly extending in a generally vertical direction;

said back assembly having an upper portion, a lower edge portion, a left side portion and a right side portion;

said back assembly including a flexible material positioned to engage the back of a user sitting in the office chair; and said back assembly being mounted to flex in response to pressure from the back of the user to support the user; and including a vertically extending back frame structure positioned external and longitudinally rearward of said back assembly; and a lumbar support structure slidably mounted to each of said back frame structure and said left and right side portions of said back assembly whereby said flexible material is spaced apart from said back frame structure, and wherein said back frame structure is spaced from said back assembly;

said back frame structure extends vertically upwardly from the rear of the support structure; and said back frame structure connects to said back assembly along said lower edge of said back assembly and at said upper portion of said back assembly; and said vertically extending back frame structure has an upper portion that is connected to said back assembly at two locations.

12. The chair back of claim 11 wherein said back frame structure is connected to said back assembly upper portion exclusively at said two locations.

13. The chair back of claim 11 wherein said upper portion of said vertically extending back frame structure terminates at two discrete laterally spaced end portions, said two discrete end portions contacting said back assembly at said two locations.

14. The chair back of claim 11 wherein said lumbar support structure is vertically adjustable relative to said back frame structure.

15. The chair back of claim 14 wherein said lumbar support structure is mounted on said back frame structure to slide generally vertically along said back frame structure.

16. The chair back of claim 11 wherein said back frame structure has an upper portion that is flared laterally and is connected to said upper portion of said back assembly at only two locations; and said lumbar support structure is vertically adjustable relative to said back frame structure.

17. The chair back of claim 16 wherein said laterally flared upper portion of said back frame structure terminates at two discrete end portions, said two discrete end portions contacting said back assembly at said two locations; and said lumbar support structure is mounted on said back frame structure to slide generally vertically along said back frame structure.

18. The chair back of claim 11 wherein said back assembly is curved in said lateral direction and also in said vertical direction.

19. The chair back of claim 11 wherein said back frame structure extends from the support structure in a rearwardly longitudinal direction before turning in an upwardly vertical direction and then in a forwardly longitudinal direction.

20. The chair back of claim 19 wherein said back assembly is curved in said lateral direction and in said vertical direction.

21. The chair back of claim 20 wherein said back frame structure has an upper portion that is flared laterally and is connected to said back assembly at only two locations.

22. The chair back of claim 21 wherein said lumbar support structure is vertically adjustable relative to said back frame support.

23. The chair back of claim 22 wherein said laterally flared upper portion of said back frame structure terminates at two discrete end portions, said two discrete end portions contacting said back assembly at said two locations; and said lumbar support structure is mounted on said frame structure to slide generally vertically along said frame structure.

* * * * *